US006886812B2

(12) United States Patent
Kazerooni

(10) Patent No.: US 6,886,812 B2
(45) Date of Patent: May 3, 2005

(54) HUMAN POWER AMPLIFIER FOR LIFTING LOAD WITH SLACK PREVENTION APPARATUS

(76) Inventor: Hamayoon Kazerooni, 2806 Ashby Ave., Berkeley, CA (US) 94705

( * ) Notice: Subject to any disclaimer, the term of this patent is extended or adjusted under 35 U.S.C. 154(b) by 86 days.

(21) Appl. No.: 10/414,897

(22) Filed: Apr. 16, 2003

(65) Prior Publication Data

US 2003/0189197 A1 Oct. 9, 2003

Related U.S. Application Data

(62) Division of application No. 10/071,311, filed on Feb. 8, 2002, now Pat. No. 6,622,990, which is a division of application No. 09/443,278, filed on Nov. 18, 1999, now Pat. No. 6,386,513.

(60) Provisional application No. 60/134,002, filed on May 13, 1999, provisional application No. 60/146,538, filed on Jul. 30, 1999, and provisional application No. 60/146,541, filed on Jul. 30, 1999.

(51) Int. Cl.[7] ..... B66D 1/00

(52) U.S. Cl. ..... 254/270; 254/264; 254/274; 254/331; 254/360; 414/5; 212/285

(58) Field of Search ..... 254/266, 270, 254/264, 274, 331, 360–362; 414/2, 4, 5; 212/330, 331, 338, 285

(56) References Cited

U.S. PATENT DOCUMENTS

| | | | | |
|---|---|---|---|---|
| 2,940,608 A | | 6/1960 | Underwood et al. | 212/124 |
| 3,384,350 A | | 5/1968 | Powell | 254/172 |
| 3,921,959 A | | 11/1975 | Ulting | 254/168 |
| 3,940,110 A | | 2/1976 | Motoda | 254/168 |
| 4,478,390 A | | 10/1984 | Knight et al. | 254/270 |
| 4,557,659 A | | 12/1985 | Scaglia | 414/627 |
| 4,844,421 A | | 7/1989 | Kojima | 254/270 |
| 4,917,360 A | | 4/1990 | Kojima | 254/362 |
| 5,270,621 A | | 12/1993 | Kiiski | 318/55 |
| 5,358,219 A | | 10/1994 | Shenk et al. | 254/269 |
| 5,480,125 A | | 1/1996 | Bitsch et al. | 254/264 |
| 5,489,032 A | | 2/1996 | Mayhall, Jr. et al. | 212/285 |
| 5,551,308 A | | 9/1996 | Arai et al. | 73/862.541 |
| 5,850,928 A | | 12/1998 | Kahlman et al. | 212/255 |
| 5,865,426 A | | 2/1999 | Kazerooni | 252/220 |
| 5,915,673 A | * | 6/1999 | Kazerooni | 254/270 |
| 6,241,462 B1 | | 6/2001 | Wannasuphoprasit et al. | |
| 6,299,139 B1 | | 10/2001 | Kazerooni | 254/270 |
| 6,386,513 B1 | | 5/2002 | Kazerooni | 254/270 |

FOREIGN PATENT DOCUMENTS

| | | |
|---|---|---|
| EP | 0428742 A | 5/1991 |
| WO | 98/43910 | 10/1998 |

OTHER PUBLICATIONS

"Dynamics and Control of Robotic Systems Worn by Humans", H. Kazerooni and S.L. Mahoney, Journal of Dynamic Systems, Measurement and Control, Sep. 1991, vol. 113, p. 379–387.

(Continued)

*Primary Examiner*—Kathy Matecki
*Assistant Examiner*—Sang Kim
(74) *Attorney, Agent, or Firm*—Brown & Michaels, PC

(57) ABSTRACT

A human power amplifier includes an end-effector that is grasped by a human operator and applied to a load. The end-effector is suspended, via a line, from a take-up pulley, winch, or drum that is driven by an actuator to lift or lower the load. The end-effector includes a force sensor that measures the vertical force imposed on the end-effector by the operator and delivers a signal to a controller. The controller and actuator are structured in such a way that a predetermined percentage of the force necessary to lift or lower the load is applied by the actuator, with the remaining force being supplied by the operator. The load thus feels lighter to the operator, but the operator does not lose the sense of lifting against both the gravitation and inertial forces originating in the load.

55 Claims, 22 Drawing Sheets

OTHER PUBLICATIONS

"Case Study On Dynamics of Hapic Devices: Human Induced Instability in Powered Hand Controllers", Kazerooni and Synder, AIAA Journal of Guidance Control and Dynamics, vol. 18, No. 1, 1995, pp 108–113.

"Human Extenders", H. Kazerooni and J. Guo, ASME Journal of Dynamic Systems, Measurement, and Control, vol. 115, No. 2(8), Jun. 1993, pp. 281–289.

"Feedback Control of Dynamic Systems", G Franklin, D., Powell, and A., Emami–Naini, Addison Wesley, 1991.

"Adaptive Control", S. Sastry and M. Bodson, Prentice Hall, 1989.

"Time Series Analysis Forecasting and Control", G. Box and G., Jenkins, Hgoolden–Day, 1976.

* cited by examiner

HUMAN POWER AMPLIFIER FOR LIFTING LOAD WITH SLACK PREVENTION APPARATUS

RELATED APPLICATIONS

This application is a Division of parent application Ser. No. 10/071,311, filed Feb. 8, 2002 by Homayoon Kazerooni, entitled Human Power Amplifier For Lifting Load With Slack Prevention Apparatus, now U.S. Pat. No. 6,622,990 which is a Division of parent application Ser. No. 09/443,278, filed Nov. 18, 1999, now U.S. Pat. No. 6,386,513, entitled Human Power Amplifier For Lifting Load Including Apparatus For Preventing Slack In Lifting Cable which parent application claims the benefit of U.S. Provisional Application Nos. 60/134,002, filed on May 13, 1999, No. 60/146,538, filed on Jul. 30, 1999, and No. 60/146,541, filed on Jul. 30, 1999. Both the parent and provisional applications are hereby incorporated by reference.

FIELD OF THE INVENTION

The present invention relates to material handling devices that lift and lower loads as a function of operator-applied force.

BACKGROUND OF THE INVENTION

The device described here is different from manual material handling devices currently used by auto-assembly and warehouse workers. Initial research generally shows three types of material handling devices are currently available on the market.

A class of material handling devices called balancers consists of a motorized take-up pulley, a line that wraps around the pulley as the pulley turns, and an end-effector that is attached to the end of the line. The end-effector has components that connect to the load being lifted. The pulley's rotation winds or unwinds the line and causes the end-effector to lift or lower the load connected to it. In this class of material handling systems, an actuator generates an upward line force that exactly equals the gravity force of the object being lifted so that the tension in the line balances the object's weight. Therefore, the only force the operator must impose to maneuver the object is the object's acceleration force. This force can be substantial if the object's mass is large. Therefore, a heavy object's acceleration and deceleration is limited by the operator's strength.

There are two ways of creating a force in the line so that it exactly equals the object weight. First, if the system is pneumatically powered, the air pressure is adjusted so that the lift force equals the load weight. Second, if the system is electrically powered, the right amount of voltage is provided to the amplifier to generate a lift force that equals the load weight. The fixed preset forces of balancers are not easily changed in real time, and therefore these types of systems are not suited for maneuvering of objects of various weights. This is true because each object requires a different bias force to cancel its weight force. This annoying adjustment must be done either manually by the operator or electronically by measuring the object's weight. For example, the pneumatic balancers made by Zimmerman International Corporation or Knight Industries are based on the above principle. The air pressure is set and controlled by a valve to maintain a constant load balance. The operator has to manually reach the actuator and set the system to a particular pressure to generate a constant tensile force on the line. The LIFTRONIC System machines made by Scaglia also belong in the family of balancers, but they are electrically powered. As soon as the system grips the load, the LIFTRONIC machine creates an upward force in the line which is equal and opposite to the weight of the object being held. These machines may be considered superior to the Zimmerman pneumatic balancers because they have an electronic circuit that balances the load during the initial moments when the load is grabbed by the system. As a result, the operator does not have to reach the actuator on top and adjust the initial force in the line. In this system, the load weight is measured first by a force sensor in the system. While this measurement is being performed, the operator should not touch the load, but instead should allow the system to find the object's weight. If the operator does touch the object, the force reading will be incorrect. As a result, the LIFTRONIC machine then creates an upward line force that is not equal and opposite to the weight of the object being held. Unlike the assist device of this application, balancers do not give the operator a physical sense of the force required to lift the load. Also, unlike the device of this application, balancers can only cancel the object's weight with the line's tension and are not versatile enough to be used in situations in which load weights vary.

The second class of material handling device is similar to the balancers described above, but the operator uses an intermediary device such as a valve, push-button, keyboard, switch, or teach pendent to adjust the lifting and lowering speed of the object being maneuvered. For example, the more the operator opens the valve, the greater will be the speed generated to lift the object. With an intermediary device, the operator is not in physical contact with the load being lifted, but is busy operating a valve or a switch. The operator does not have any sense of how much she/he is lifting because his/her hand is not in contact with the object. Although suitable for lifting objects of various weights, this type of system is not comfortable for the operator because the operator has to focus on an intermediary device (i.e., valve, push-button, keyboard, or switch). Thus, the operator pays more attention to operating the intermediary device than to the speed of the object, making the lifting operation rather unnatural.

The third class of material handling device use end-effectors equipped with force sensors or motion sensors. These devices measure the human force or motion and based on this measurement vary the speed of the actuator. An example of such a device is U.S. Pat. No. 4,917,360 to Yasuhiro Kojima. With this and with similar devices, if the human pushes upward on the end-effector the pulley turns and lifts the load; and if the human pushes downward on the end-effector, the pulley turns and lowers the load. A problem occurs when the operator presses downward on the end-effector to engage the load with the suction cups, the controller and actuator interpret this motion as an attempt to lower the load. As a result, the actuator causes the pulley to release more line than necessary, creating "slack" in the cable. Hereinafter the term "slack" should be interpreted as meaning an excessive length of line but should not be construed as including instances where the line is simply not completely taut. A slack line may wrap around the operator's neck or hand. After the slack is produced in the line by this or other circumstances, when the operator pushes upwardly on the handle, the slack line can become tight around the operator's neck or hand creating deadly injuries. Because slack can occur even when suction cups are not used as the load gripping means, for safe operation it is important to prevent slack at all times. During fast maneuvers workers can accidentally hit the loads they intend to lift or their surrounding environment (e.g. conveyor belts) with the bottom of the end-effector. In palletizing tasks, the workers quite often use the bottom of the end-effector to fine tune the locations of a box that is not well placed. These occurrences will cause slack in the line since the operator pushes downwardly on the end-effector handle to situate a box, while the end-effector is constrained from moving downwardly. In general, slack in the line can be dangerous for the operator and others the same work environment. The manual material handling device of my invention never creates slack in the line.

The force sensor devices of this class also fail to give an operator a realistic sense of the weight of the load being lifted. This can lead to unnatural and possibly dangerous load maneuvers.

SUMMARY OF THE INVENTION

The assist device of this application solves the above problems associated with the three classes of material handling devices. The hoist of this invention includes an end-effector to be held by a human operator; an actuator such as an electric motor; a computer or other type of controller for controlling the actuator; and a line, cable, chain, rope, wire or other type of line for transmitting a tensile lifting force between the actuator and the end-effector. Hereinafter the term "lifting" should be interpreted as including both upward and downward movements of a load. The end-effector provides an interface between the human operator and an object that is to be lifted. A force transfer mechanism such as a pulley, drum or winch is used to apply the force generated by the actuator to the line that transmits the lifting force to the end-effector.

A signal representing the vertical force imposed on the end-effector by the human operator, as measured by a sensor, is transmitted to the controller that is associated with the actuator. In operation, the controller causes the actuator to rotate the pulley and move the end-effector appropriately so that the human operator only lifts a pre-programmed small proportion of the load force while the remaining force is provided by the actuator. Therefore, the actuator assists the operator during lifting movements in response to the operator's hand force. Moreover, the tensile force in the line is detected or estimated, for example, by detecting the energy or current that is drawn by an actuator. In addition, because load force is a dominating factor in establishing the magnitude of tensile force, load force can be used to roughly approximate tensile force and vice versa. Hereinafter, it should be understood that tensile force can be estimated using load force and load force can be estimated using tensile force. A signal representing the load force or tensile force on the line is sent to the controller, and the controller uses the load force or tensile force signal to drive the actuator effectively in response to the human input. This, for example, can prevent the actuator from releasing line when the load force or tensile force is zero so that although the line may become loose (i.e. not taut), slack (as defined above) will never be created in the line.

With this load sharing concept, the operator has the sense that he or she is lifting the load, but with far less force than would ordinarily be required. The force applied by the actuator takes into account both the gravitational and inertial forces that are necessary to move the load. Since the force applied by the actuator is automatically determined by line force and the force applied to the end-effector by the operator, there is no need to set or adjust the human power amplifier for loads having different weights. There is no switch, valve, keyboard, teach pendent or push-button in the human power amplifier to control the lifting speed of the load. Rather, the contact force between the human hand and the end-effector handle combined with line force are used to determine the lifting speed of the load. The human hand force is measured and used by the controller in combination with line force to assign the required angular speed of the pulley to either raise or lower the line and thus create sufficient mechanical strength to assist the operator in the lifting task. In this way, the device follows the human arm motions in a "natural" way. When the human uses this device to manipulate a load, a well-defined small portion of the total load force (gravity plus acceleration) is lifted by the human operator. This force gives the operator a sense of how much weight he/she is lifting. Conversely, when the operator does not apply any vertical force (upward or downward) to the end-effector handle, the actuator does not rotate the pulley at all, and the load hangs motionless from the pulley.

Although the existing devices described in earlier paragraphs do lift loads, they:

do not give the operator a physical sense of the lifting maneuver, do not compensate for inertia forces, do not compensate for varying loads, do not address any key ergonomic concerns, and do not prevent slack in the line.

The device of this application does have the above-identified advantages.

DETAILED DESCRIPTION OF THE INVENTION

Figure 1:
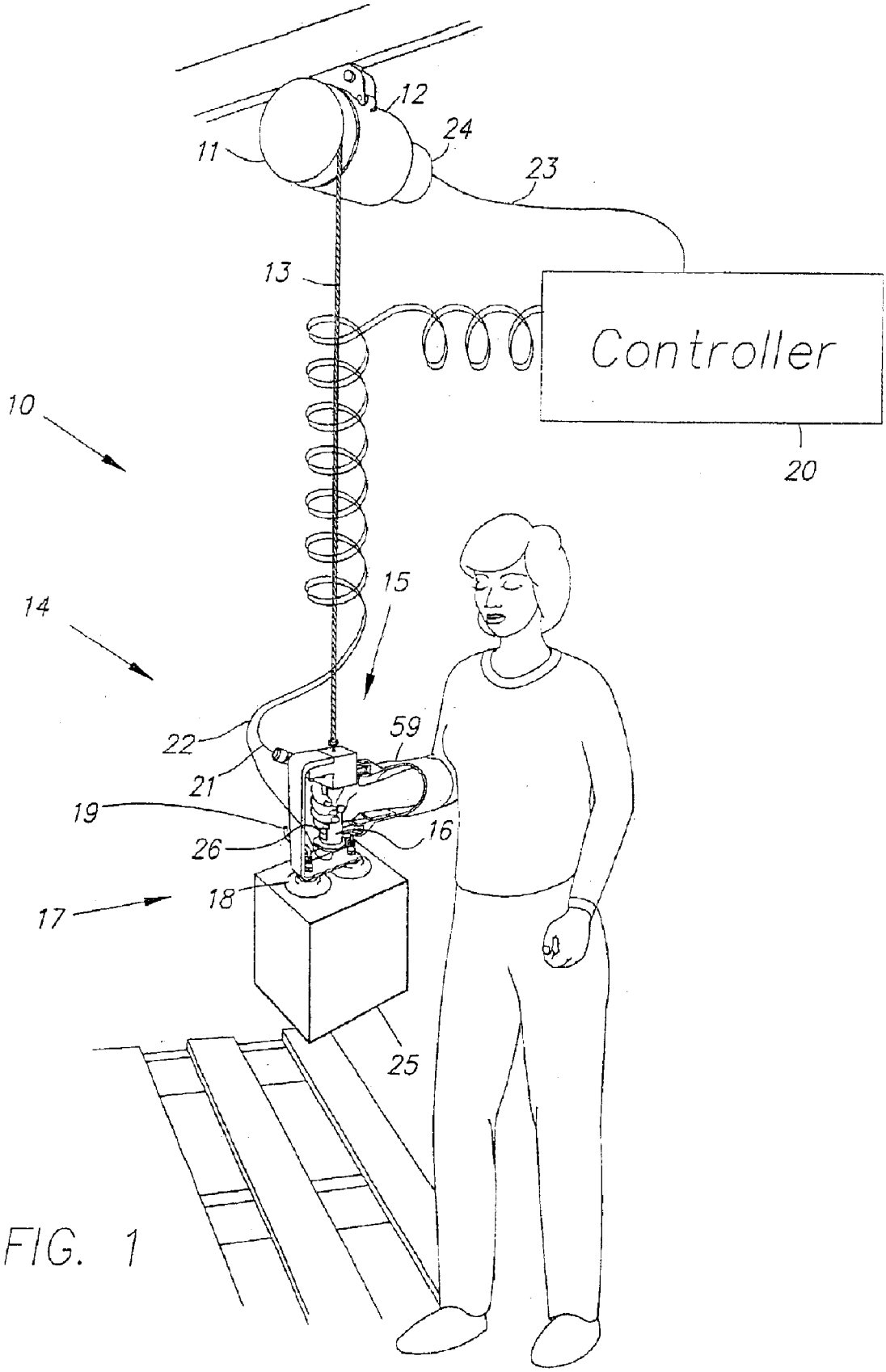
FIG. 1 illustrates one embodiment of a human power amplifier that includes an end-effector according to this invention.

FIG. 1 illustrates a first embodiment of the invention, showing a human power amplifier 10. At the top of the device, a take-up pulley 11, driven by an actuator 12, is attached directly to a ceiling, wall, or overhead crane. Encircling pulley 11 is a line 13. Line 13 is capable of lifting or lowering a load 25 when the pulley 11 turns. Line 13 can be any type of line, wire, cable, belt, rope, wire line, cord, twine, string or other member that can be wound around a pulley and can provide a lifting force to a load. Attached to line 13 is an end-effector 14, that includes a human interface subsystem 15 (including a handle 16) and a load interface subsystem 17, which in this embodiment includes a pair of suction cups 18. Also, shown is an air hose 19 for supplying suction cups 18 with low-pressure air.

In the preferred embodiment, actuator 12 is an electric motor with a transmission, but alternatively it can be an electrically-powered motor without a transmission. Furthermore, actuator 12 can also be powered using other types of energy including pneumatic, hydraulic, and other alternative forms of energy. As used herein, transmissions are mechanical devices such as gears, pulleys and lines that increase or decrease the tensile force in the line. Pulley 11 can be replaced by a drum or a winch or any mechanism that can convert the motion provided by actuator 12 to vertical motion that lifts and lowers line 13. Although in this embodiment actuator 12 directly powers the take-up pulley 11, one can mount actuator 12 at another location and transfer power to take-up pulley 11 via another transmission system such as an assembly of chains and sprockets. Actuator 12 is driven by an electronic controller 20 that receives signals from end-effector 14 over a signal cable 21. Because there are several ways to transmit electrical signals, signal cable 21 can be replaced by other alternative signal transmitting means (e.g. RF, optical, etc.). In a preferred embodiment controller 20 essentially contains three major components:

1. An analog circuit, a digital circuit, or a computer with input output capability and standard peripherals. The responsibility of this portion of the controller is to process the information that is received from various sensors and switches and to generate command signals for the actuator.

2. A power amplifier that sends power to the actuator based on a command from the computer discussed above. In general, the power amplifier receives electric power from a power supply and delivers the proper amount of power to the actuator. The amount of electric power supplied by the power amplifier to actuator 12 is determined by the command signal computed within the computer.

3. A logic circuit composed of electromechanical or solid state relays, to start and stop the system depending on a sequence of possible events. For example, the relays are used to start and stop the entire system operation using two push buttons installed either on the controller or on the end-effector. The relays also engage the friction brake in the presence of power failure or when the operator leaves the system. In general, depending on the application, one can design many architectures for logic circuit.

Human interface subsystem 15 is designed to be gripped by a human hand and measures the human force, i.e., the force applied by the human operator against human interface subsystem 15. Load interface subsystem 17 is designed to interface with a load and contains various holding devices. The design of the load interface subsystem depends on the geometry of the load and other factors related to the lifting operation. In addition to the suction cup 18 shown in FIG. 1, hooks and grippers are examples of other means that connect to load interface subsystems. For lifting heavy objects, the load interface subsystem can contain more than two suction cups.

The human interface subsystem 15 of end-effector 14 contains a sensor (described below) that measures the magnitude of the vertical force exerted by the human operator. If the operator's hand pushes upward on the handle 16, the take-up pulley 11 moves the end-effector 14 upward. If the operator's hand pushes downward on the handle 16, the take-up pulley moves the end-effector 14 downward. The measurements of the forces from the operator's hand are transmitted to the controller 20 over signal cable 21 (or alternative signal transmission means). Furthermore, while the preferred embodiment of my system includes a sensor positioned in proximity to the end-effector 14, other operator-applied force estimating elements can be used to estimate operator-input that are not in proximity to the end-effector 14.

Using these measurements, the controller 20 assigns the necessary pulley speed to either raise or lower the line 13 to create enough mechanical strength to assist the operator in the lifting task as required. Controller 20 then powers actuator 12, via power cable 23, to cause pulley 11 to rotate. All of this happens so quickly that the operator's lifting efforts and the device's lifting efforts are for all purposes synchronized perfectly. The operator's physical movements are thus translated into a physical assist from the machine, and the machine's strength is directly and simultaneously controlled by the human operator. In summary, the load moves vertically because of the vertical movements of both the operator and the pulley. One of the most important properties of the device of this invention is that the actuator and pulley turn causing the end-effector to follow the operator's hand motion upwardly and downwardly yet the line does not become slack if the end-effector is physically constrained from moving downwardly and the end-effector is pushed downwardly by the operator.

A dead-man switch with a lever 26 on handle 16 (described below) sends a signal to controller 20 via a signal cable 22 (or other alternative signal transmission means). When the operator holds onto handle 16, the dead-man switch sends a logic signal to the controller 20 causing the end-effector to follow the operator's hand. When the operator releases handle 16, the dead-man switch sends a different logic signal to the controller 20 causing the end-effector to remain stationary. In a preferred embodiment of this invention, a friction brake 24 has been installed on the actuator 12. The friction brake engages whenever the operator releases the dead-man switch or at any time there is a power failure. One can use an end-effector with two handles, only one of which needs to be instrumented with a sensor to measure operator-applied force. For lifting heavy objects, one can use two human power amplifiers similar to the human power amplifier 10 shown in FIG. 1, one for the left and one for the right hand.

I first describe, in detail, the architecture of two classes of end-effectors that allow for measurement of the operator force. I will then explain the control algorithm that allows for the operation of the system and prevention of the slack in the line. A flow chart is also given to explain the implementation of the control algorithm.

Figure 2:
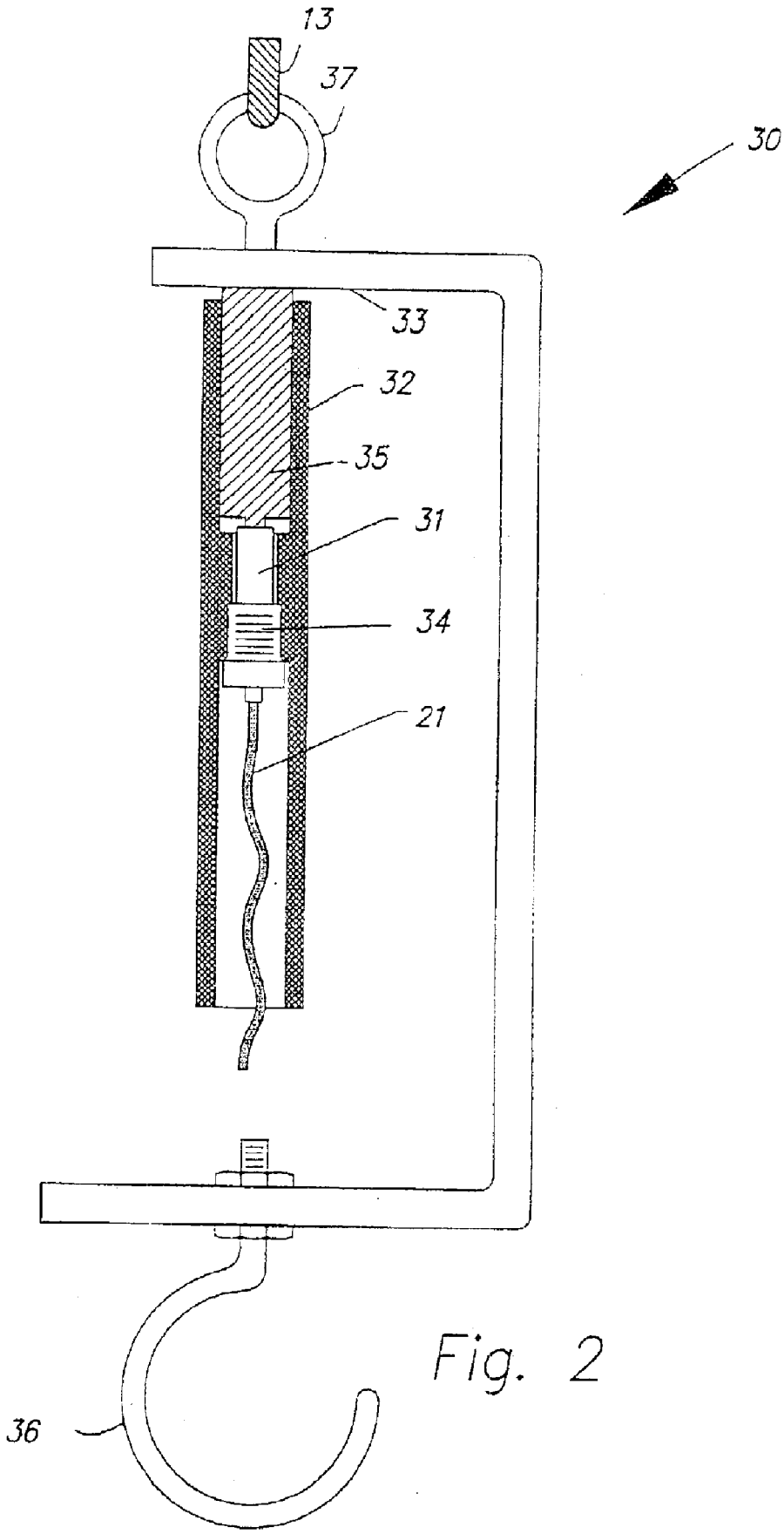
FIG. 2 illustrates a cross-sectional view of one embodiment of an end-effector usable in the invention, showing in particular the structure of the force sensor that measures operator force.

Two families of the end-effectors are described here. FIG. 2 shows a version of end-effector 30 that measures the vertical human force via a force sensor. A force sensor 31 is installed between a handle 32 and a bracket 33 and is connected to controller 20 via signal cable 21. Force sensor 31 has a threaded part 34 that screws into an inside bore within handle 32, which is grasped by the operator. The other side of the force sensor 31 is connected to bracket 33 via a cylinder 35. The outside diameter of cylinder 35 is slightly smaller than the inside diameter of handle 32. This clearance allows a sliding motion between handle 32 and cylinder 35, guaranteeing that the forces from the operator that are in the vertical direction pass through force sensor 31 without any resistance and that the forces from the operator that are not in the vertical direction are transferred to bracket 33 and not to force sensor 31. If these non-vertical forces were to pass through force sensor 31, they could either introduce false readings in the sensor or damage the force sensor assembly.

The force sensor used in embodiments of this invention can be selected from a variety of force sensors that are available in the market, including piezoelectric based force sensors, metallic strain gage force sensors, semiconductor strain gage force sensors, Wheatstone bridge-deposited strain gage force sensors, and force sensing resistors. Regardless of the particular type of force sensor chosen and its installation procedure, the design should be such that the force sensor 31 measures only the operator force against the end-effector 30. Bracket 33 is connected to cylinder 35 rigidly and it includes hook 36 to interface the load and eyelet 37 to be connected to the line 13.

Figure 3:
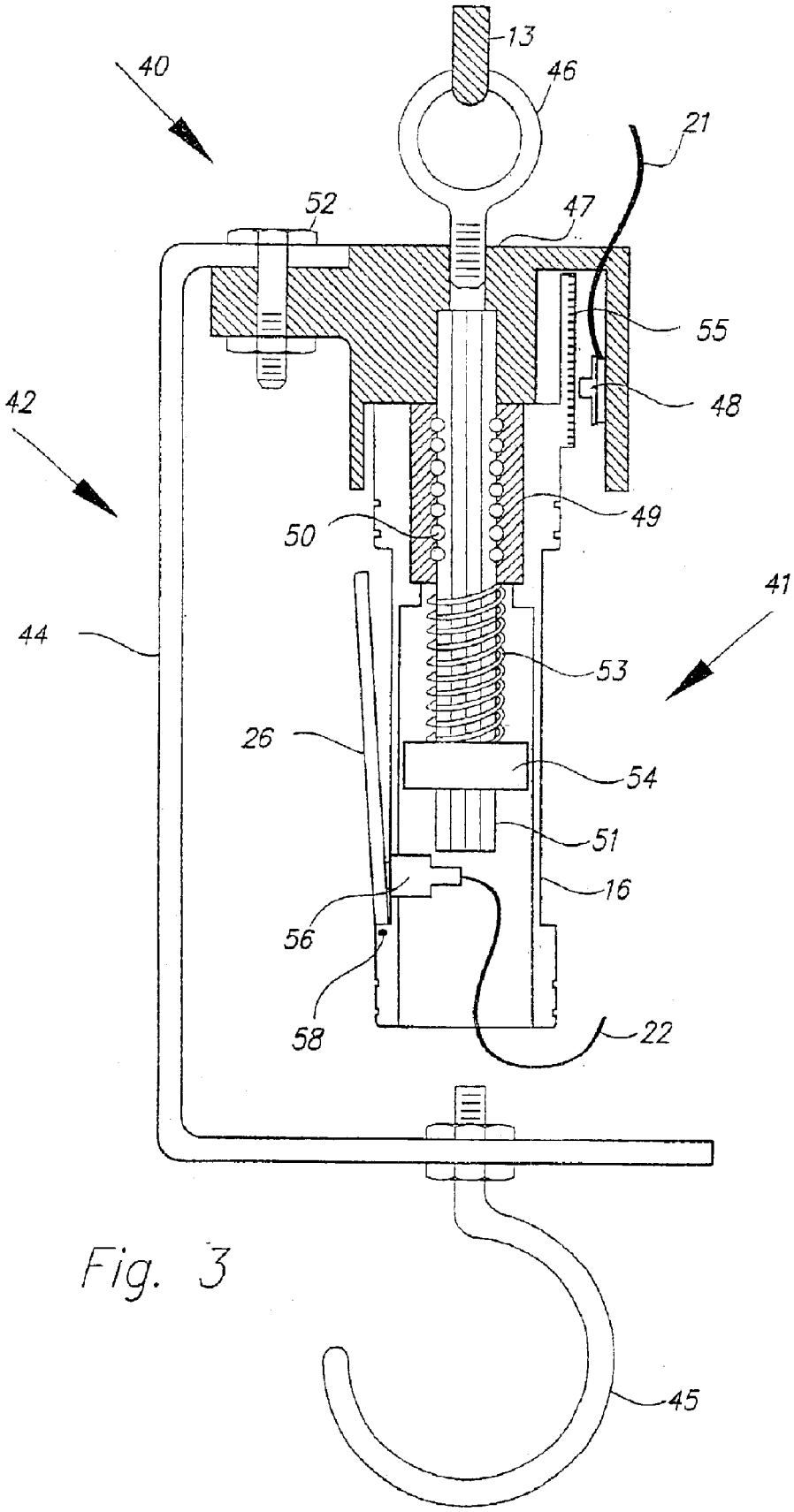
FIG. 3 illustrates a cross-sectional view of one embodiment of another end-effector that includes a displacement detector for measuring the force imposed on the end-effector by an operator.
Figure 4:
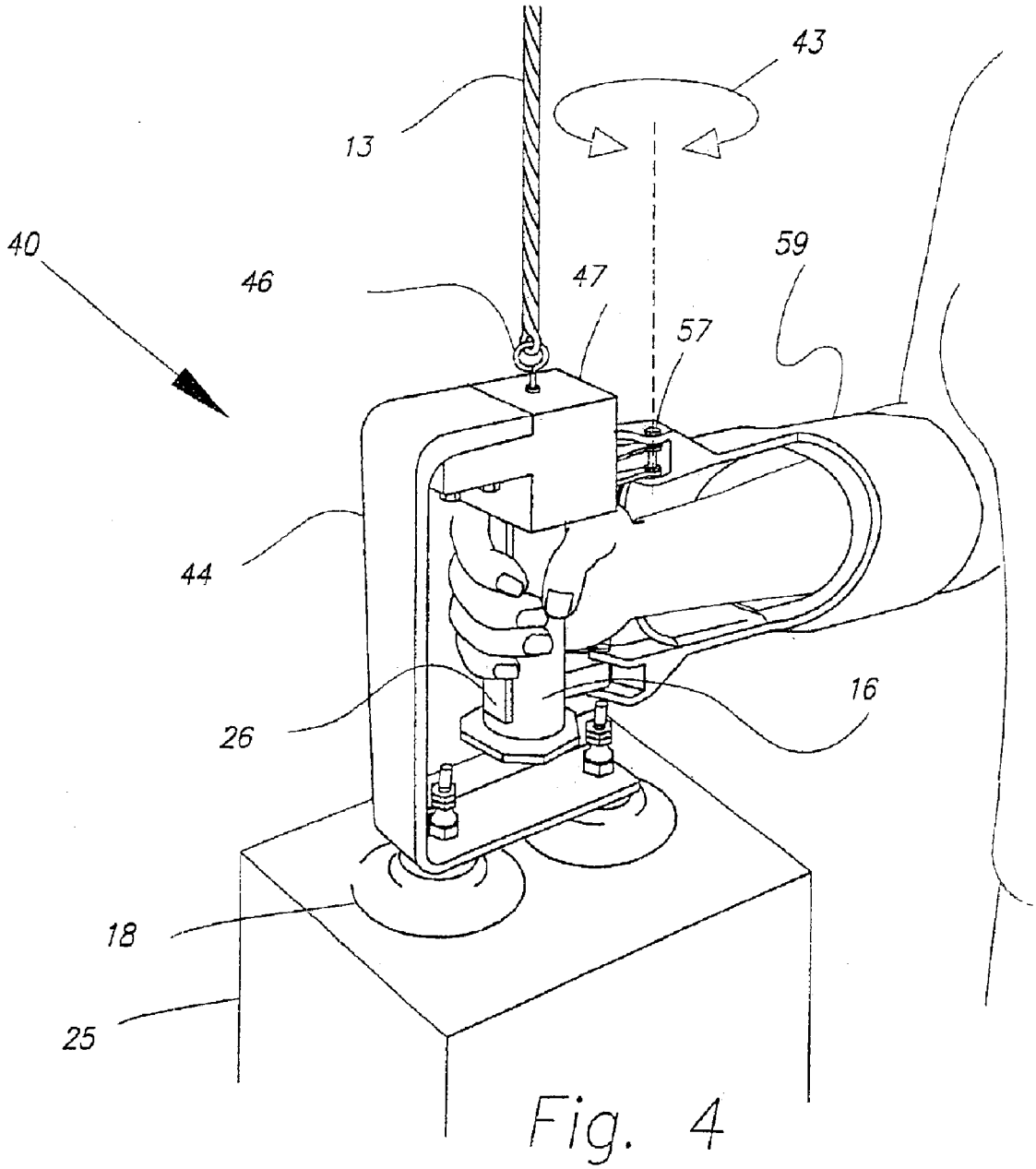
FIG. 4 illustrates a perspective view of the end-effector of FIG. 3 when used by an operator to lift a box.

In a second group of embodiments, the force imposed by the operator against the end-effector is measured by the displacement of the handle rather than a force sensor of the kind described above. The lower cost and ease of use of displacement measurement systems can make this type of end-effector more attractive in some situations. A partially cross-sectioned view of one embodiment of an end-effector of the second group is shown in FIG. 3. FIG. 4 shows a perspective view of the end-effector of FIG. 3 when used by an operator to lift box 25. Similar to the end-effector described above, end-effector 40 includes a human interface subsystem 41 and a load interface subsystem 42. Human interface subsystem includes a handle 16 that is grasped by the operator and thus measures the human force, not the load force. Load interface subsystem 42 includes a bracket 44 that bolts to a hook 45 or a suction cup or any other type of device that can be used to hold an object. An eyelet 46 is mounted in bracket 47 for connecting bracket 47 to a line 13.

A handle 16 is held by the operator and connected rigidly to the ball-nut portion 49 of the ball spline shaft mechanism securely. Balls 50 located in grooves of spline shaft 51 allow for linear motion of ball-nut 49 and handle 16 freely along a spline shaft 51, with no rotation relative to spline shaft 51. The spline shaft 51 is secured to bracket 47, which is connected to line 13 via an eyelet 46.

In this embodiment, the spline shaft 51 is press fitted into bracket 47. Member 44 holding a hook 45 is connected to bracket 47 via bolts 52. Member 44 has hole patterns that allow for connection of a suction cup mechanism, a hook, or any device to hold the object. A coil spring 53 is positioned around spline shaft 51 between the ball-nut portion 49 of the ball-spline shaft mechanism and a stop 54 and urges handle 16 upward. Note that stop 54 can be a clamp ring that is secured to spline shaft 51 rigidly.

In this embodiment, a linear encoder measures the motion of the handle 16 relative to bracket 47. The encoder system has a sensor 48 that produces an electric signal on signal cable 21. The encoder also has a reflective strip 55 mounted on handle 16 by adhesive. The reflective strip has dark horizontal stripes. As the handle moves linearly relative to bracket 47, the sensor 48 detects the light and dark regions of the strip 55 and sends appropriate pulses via signal cable 21 as it observes the light (or dark) regions of the strip 55. The leading and trailing edges of pulse signals will then be counted in the controller 20. FIG. 3 shows the end-effector when handle 16 is pushed upwardly to its upper limit (the bull-nut 49 is pushed against the bracket 47). Rather than gluing a reflective strip with dark stripes on handle 16, one can laser mark the handle 16 itself. The controller assumes zero position for the handle 16 at this location and calculates the handle displacement by counting the pulses carried over the signal cable 21. The handle displacement and the spring stiffness, taken together, yield a value for the human force. The linear motion detector used in this embodiment can be a magnetic linear encoder, a linear potentiometer, a LVDT (linear variable differential transformer), a capacitive displacement sensor, an eddy current proximity sensor or a variable-inductance proximity sensor.

Alternatively, the ball spline shaft mechanism shown in FIG. 3 can be replaced by a linear bushing mechanism, wherein a bushing (slider) and a shaft slide relative to one another with no balls. There should be little friction between the bushing (slider) and the shaft.

A dead-man switch 56 is installed on handle 16 sends a signal to controller 20 via signal cable 22 (or by alternative signal transmission means). A lever 26, pivoting around hinge 58, is installed on the handle 16 and pushes against the switch 56 when the operator holds onto handle 16. In a preferred embodiment of this invention, a friction brake 24 has been installed on the actuator 12. This friction brake engages when the operator releases the dead-man switch and any time there is a power failure. In addition, as an optional feature, the assist device controller can be designed so that when the operator leaves the handle 16, the controller transfers the actuator to position control mode. In position control mode, the controller tries to keep the actuator (and consequently the end-effector) at the position where the operator left the device. As soon as the operator returns and grasps the handle 16, the actuator moves out of position control mode. In a preferred embodiment, the position control mode includes a standard feedback system that uses the encoder on the actuator as a feedback signal and maintains the position of the actuator where the operator left the device. Although this optional feature holds the actuator and the end-effector stationary when the operator leaves the handle, I do not recommend that practitioners substitute this feature for the friction brake discussed above. The position control feature will not work if there is a sensor, computer or power failure.

The sole purpose of the spring installed in the end-effector is to bring the handle back to an equilibrium position when no force is imposed on the handle by the operator. FIG. 3 shows the end-effector using compression springs. One can use other kinds of springs, such as cantilever beam springs, tension springs or belleville springs in the end-effector. Basically, any resilient element capable of bringing the handle back to its equilibrium position will be sufficient. For example, one can use a bellow not only to protect the end-effector from dust and moisture, but also to bring back the handle to its equilibrium position. The structural damping in the resilient element (e.g. springs) or the friction in the moving elements of the end-effectors (e.g. bearings) provide sufficient damping in the system to provide stability. As shown in FIG. 3, only one spring is used to push the handle upwardly. However, one can also use two springs to keep the handle at a middle position. The second spring can be positioned around spline shaft 51 between the ball-nut portion 49 of the ball-spline shaft mechanism and bracket 47 and urges handle 16 downwardly. As shown in FIG. 4 an optional brace 59 can be connected to handle 16 to create stability and comfort for operators. This brace 59 has a hinge 57 and allows for a rotational motion along arrow 43. Because brace 59 transfers all forces imposed on the operator's hand to the operator's lower arm, by-passing the operator's wrist, some operators may find that brace 59 makes operation more comfortable.

As explained above, other types of operator-input estimating elements can be used in place of the specific embodiments described above. Examples of alternative operator-input estimating elements may include sensors that evaluate energy consumed by the actuator during lifting or sensors that are not in proximity to the end-effector that can estimate load force or tensile force to estimate operator-applied force.

Figure 5:
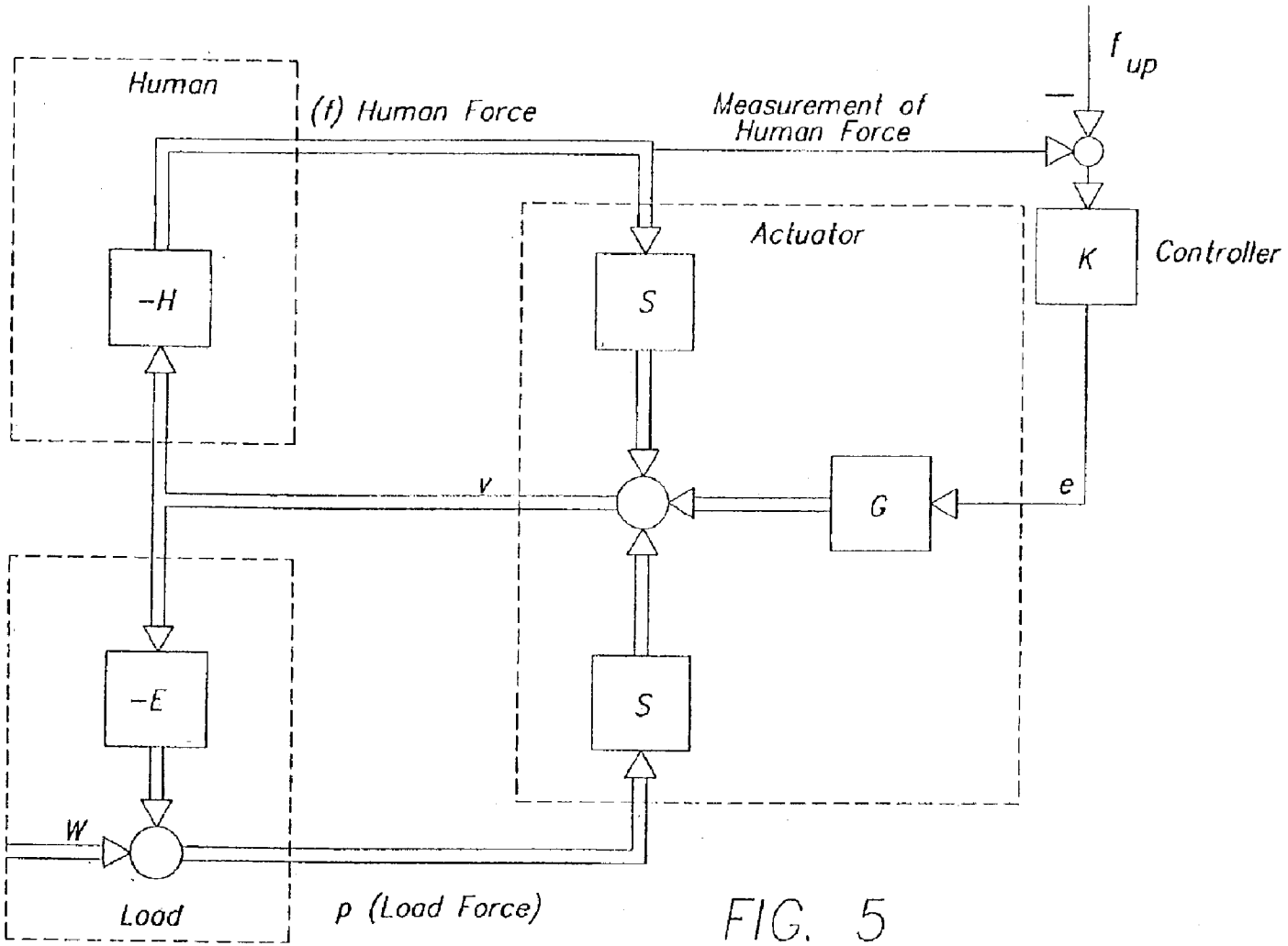
FIG. 5 is a schematic block diagram showing operator and load forces interacting with elements of the human power amplifier to provide load movement.

The block diagram of FIG. 5 shows the basic control technique of the device. As described above, in a preferred embodiment, the force or displacement sensor in the end-effector delivers a signal to controller 20 that is used to control actuator 12 and to apply an appropriate torque to pulley 11. If (e) is the input command to actuator 12 then, in the absence of any other external torque on the actuator, the linear velocity of the outermost point of the pulley or the velocity of the end-effector (v) can be represented by:

$$v=Ge \tag{1}$$

where (G) is the actuator transfer function. A positive value for (v) means downward speed of the end-effector. In addition to the input command (e) from the controller, the line tensile force, ($f_R$) will also affect the end-effector velocity. The input command (e) and the line tensile force, ($f_R$), contribute to the end-effector velocity such that:

$$v=Ge+Sf_R \tag{2}$$

where (S) is the actuator sensitivity transfer function which relates the line tensile force ($f_R$) to the end-effector velocity (v). If a closed loop velocity controller is designed for the actuator such that (S) is small, the actuator has only a small response to the line tensile force. A high-gain controller in the closed-loop velocity system results in a small (S) and consequently a small change in velocity, (v), in response to the line tensile force. Also note that non-back-driveable speed reducers (usually high transmission ratios) produce a small (S) for the system.

The line tensile force, ($f_R$), can be represented by equation 3:

$$f_R=f+p \tag{3}$$

where (f) is the operator-applied force on the end-effector and force (p) is imposed by the load and the end-effector, referred to herein as the "load force" on the line. Positive values for (f) and (p) represent downward forces. Note that (p) is force imposed on the line and is equal to the weight and inertia force of the load and end-effector taken together:

$$p = W - \frac{W}{g}\frac{d}{dt}v \tag{4}$$

where W is the weight of the end-effector and load taken together as a whole and $$\left(\frac{d}{dt}v\right)$$

is the end-effector acceleration. If the end-effector and load do not have any acceleration or deceleration, then (p) is exactly equal to the weight of the end-effector and load, (W). Also note that inspection of FIG. 5 and equation 4 reveals that variable (E) in the block diagram of FIG. 5 presents $$\frac{W}{g}\frac{d}{dt}$$

in equation 4, therefore p=W−Ev.

The human force, (f), is measured and passed to the controller 20 that delivers the output signal (e). A positive number ($f_{up}$), in the computer, is subtracted from the measurement of the human force, (f). The role of ($f_{up}$) will be explained below. If the transfer function of the controller is represented by (K), then the output of the controller (e) is:

$$e=K(f-f_{up}) \tag{5}$$

Substituting for ($f_R$) and (e) from equations (3) and (5) into equation (2) results in the following equation for the end-effector velocity (v):

$$v=GK(f-f_{up})+S(f+p) \tag{6}$$

Measuring an upward human force on the end-effector is only possible when the line is under tension caused by the weight of the end-effector. If the end-effector is light, then the full range of human upward forces may not be measured by the sensor in the end-effector. To overcome this problem, a positive number, ($f_{up}$), is introduced in equation (5). As equation (6) shows, in the absence of (f) and (p), ($f_{up}$) will cause the end-effector to move upwardly. Suppose the maximum downward force imposed by the operator is $f_{max}$. Then ($f_{up}$) is preferably set approximately at the half of $f_{max}$. Substituting for ($f_{up}$), equation (7) represents the load velocity:

$$v = GK\left(f - \frac{f_{\max}}{2}\right) + S(f + p) \tag{7}$$

If the operator pushes downwardly such that $f=f_{max}$, then the maximum downward velocity of the end-effector is:

$$v_{Down} = GK\left(\frac{f_{\max}}{2}\right) + S(f_{\max} + p) \tag{8}$$

If the operator does not push at all, then the maximum upward velocity of the end-effector is:

$$v_{Up} = -GK\left(\frac{f_{\max}}{2}\right) + S(p) \tag{9}$$

Therefore, by the introduction of ($f_{up}$) in equation (5), one does not have to worry about the measurement of the upward human force. If S=0, the upward and downward maximum speeds are identical in magnitude. However in the presence of non-zero S, for a given load and under equal conditions, the magnitude of the maximum upward speed is smaller than the magnitude of the maximum downward speed. This is very natural and intuitive for the operator.

Going back to equation (6), it can be observed that the more force an operator imposes on the end-effector, the larger the velocity of the load will be. Using the measurement of the operator force, the controller assigns the pulley speed properly to create enough mechanical strength to assist the operator in the lifting task. In this way, the end-effector follows the human arm motions in a "natural" way. In other words the pulley, the line, and the end-effector mimic the lifting/lowering movements of the human operator, and the operator is able to manipulate heavy objects more easily without the use of any intermediary device.

I now describe some important characteristics of this device via three experiments. Substituting for p in equation 6 and rearranging its terms results in equation 10:

$$(1+SE)v=(GK+S)f-GK(f_{up})+S(W) \tag{10}$$

Equation (11) shows that any change in the load weight, (ΔW), and any change in the force imposed by the operator on the end-effector, (Δf), will result in a variation of the end-effector speed, (Δv), such that:

$$(1+SE)\Delta v=(GK+S)(\Delta f)+S(\Delta W) \tag{11}$$

Experiment 1

If Δv=0 for two different objects being maneuvered (i.e. the operator maintains similar operational speeds), then:

$$0=(GK+S)(\Delta f)+S(\Delta W) \tag{12}$$

Rearranging the terms of equation (12) results in equation (13):

$$\frac{GK}{S} + 1 = -\frac{\Delta W}{\Delta f} \tag{13}$$

Equation (13) indicates that an increase or a decrease in the load weight (ΔW) will lead to an increase or a decrease in the upward human force, if operational speed is expected to remain unchanged. In other words, if the load weight is increased, the operator needs to increase his/her upward hand force or decrease his/her downward force to maintain the same operational speed. The term (GK/S+1) in equation (13) is the force amplification factor. The larger (K) is chosen to be, the greater the force amplification in the system will be. Consequently, if the force amplification is large, the operator "feels" only a small percentage of the change of the load weight. Essentially, the operator still retains a sensation of the dynamic characteristics of the free mass, yet the load essentially "feels" lighter. This method of load sharing gives the operator a sense of how much he/she is lifting. Inspection of equation (13) shows that, variations in load weight, (ΔW), results in a small variation in the operator force, (Δf), if (S) is a small quantity. In other words, the operator will have little feeling of the variation in the load weight if (S) is a small quantity. I will explain later how to cure this problem and give a more pronounced feeling of the load variation to the operator when (S) is a small quantity. Also, note that at very low frequencies (rather slow and smooth maneuvers), the left side of equation 13 approaches a large number. This indicates that an increase or decrease in the load weight (ΔW) will lead to a very small increase or a decrease in the upward human force (almost unnoticeable), if operational speed is expected to remain unchanged. However, at higher frequencies (rather fast and harsh maneuvers), the operator will have a more pronounced feeling of the load weight variation. In other words, if the operator is performing a relatively slow lifting movement, the additional force necessary to maintain operational speed of a heavier load versus a lighter load may be unnoticeable. But if the operator is performing a rapid lifting movement, the additional force necessary to maintain operational speed of a heavier load versus a lighter load may be more noticeable.

Experiment 2

If Δf=0, (i.e. operator decides to maintain similar forces on the end-effector for two different load weights), then equation (11) reduces to:

$$(1+SE)\Delta v=S(\Delta W) \tag{14}$$

This means that an increase in load weight, (ΔW), will lead to an increase of downward speed, if the operator maintains a constant hand force. Moreover an increase or decrease in the weight of the load, (ΔW), will cause a decrease or increase, respectively, in the upward end-effector speed for a given operator force on the end-effector. Essentially, the load falls faster and goes up slower if there is an increase in the load weight for a given operator force. From equations (13) and (14), it can be deduced that for an increase of load weight, the operator needs either to increase his/her upward force to maintain similar operational speed or to decrease his/her upward operational speed to maintain similar force on his/her hand. This dynamic behavior is very comforting and natural for the workers.

Experiment 3

Finally, if ΔW=0, (i.e. the load weight is constant), then:

$$(1+SE)\Delta v=(GK+S)\Delta f \quad (15)$$

This means that an increase or a decrease in the operator downward force (Δf) will lead to an increase or a decrease, respectively, in the downward operational speed, if the load weight is unchanged. One can also interpret equation (15) differently: for a given load weight, an increase in operational speed requires more operator force. In general, the larger (K) is chosen to be, the less the operator force will be.

As FIG. 5 indicates, (K) may not be arbitrarily large. Rather, the choice of (K) must guarantee the closed-loop stability of the system shown in FIG. 5. The human force (f) is a function of human arm impedance (H), whereas the load force (p) is a function of load dynamics (E), i.e. the weight and inertial forces generated by the load. One can find many methods to design the controller transfer function (K). An article entitled "A Case Study on Dynamics of Haptic Devices: Human Induced Instability in Powered Hand Controllers," by Kazerooni and Snyder, published in AIAA Journal of Guidance, Control, and Dynamics, Vol. 18, No. 1, 1995, pp. 108–113, incorporated herein by reference, describes the conditions for the closed loop stability of the system. Practitioners are not confined to one choice of controller; a simple low pass filter as a controller, in many cases, is adequate to stabilize the system of FIG. 5. Some choices of linear or non-linear controllers may lead to a better overall performance (large force amplification and high speed of operation) in the presence of variation of human arm impedance (H) and load dynamics (E).

The choice of (K) also depends on the available computational power; elaborate control algorithms to stabilize the closed system of FIG. 5 while yielding a large force amplification with high speed of maneuvers might require a fast computer and a large memory. An article entitled "Human Extenders," by H. Kazerooni and J. Guo, published in ASME Journal of Dynamic Systems, Measurements, and Control, Vol. 115, No. 2(B), June 1993, pp. 281–289, incorporated herein by reference, describes stability of the closed loop system and a method of designing (K).

One can arrive at the theoretical values of (G) and (S) using standard modeling techniques. There are many experimental frequency domain and time domain methods for measuring (S) and (G), which yield superior results. I recommend the use of a frequency domain technique in identifying (G) and (S). For example the book titled "Feedback Control of Dynamic Systems," by G. Franklin, D. Powell, and A. Emami-Naeini, Addison Wesley, 1991, describes in detail the frequency-domain and time-domain methods for identifying various transfer functions.

Note that linear system theory was used here to model the dynamic behavior of the elements of the system. This allows me to disclose the system properties in their simplest and most commonly used form. Since most practitioners are familiar with linear system theory, they will be able to understand the underlying principles of this invention using mathematical tools of linear system theory (i.e. transfer functions). However, one can also use nonlinear models and follow the mathematical procedure described above to describe the system dynamic behavior.

Figure 6:
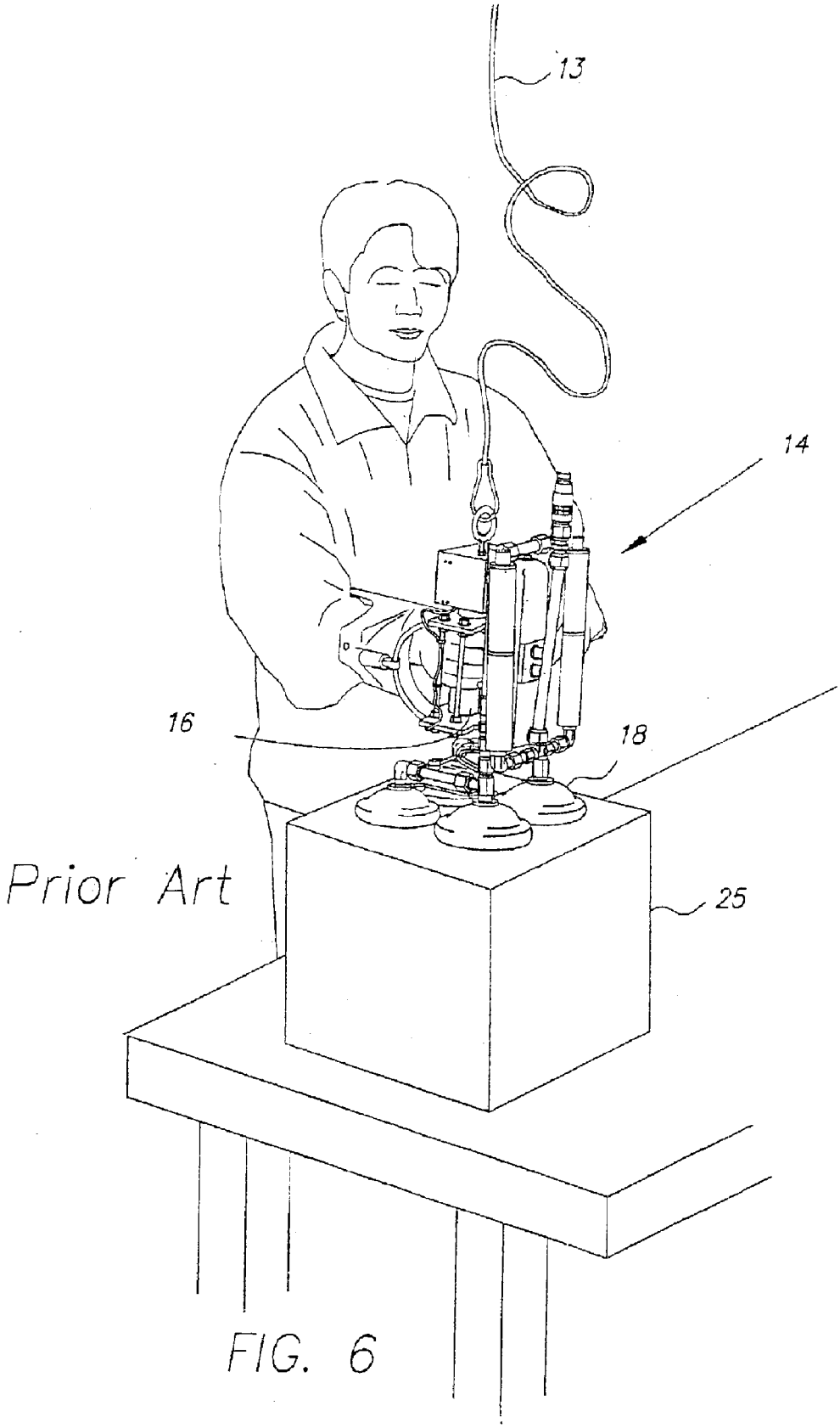
FIG. 6 illustrates the problem of line slack that can occur with prior art devices that use suction cups to grip a box.

A special problem can occur in the device when the operator pushes downward on the end-effector but the end-effector is prevented from moving downward. This situation can be explained with the help of the following example using suction cups as the load gripping means. As shown by the end-effector 14 in FIG. 6, if the operator pushes the handle 16 downward to ensure firm engagement of the suction cups 18 with the box 25, the actuator (not shown in FIG. 6) will unwind the line 13. This occurs because the controller, reacting to the downward human force on the end-effector 14, concludes incorrectly that the operator wants to lower the end-effector and sends a command signal to the actuator which causes the actuator to unwind the line 13. In some instances the unwound "slack" portion of line 13 can amount to a few feet. After the engagement of the suction cups 18 with the box 25, when the operator pushes the handle 16 upward to lift the box, the actuator and pulley must take up the slack in line 13 before the box 25 is lifted. This impedes the operator since he has to wait while the actuator winds the slack in line 13. Moreover, the sudden change in the line tensile force from zero (i.e. when the line is slack) to a non-zero value (i.e. when the line is not slack), will jerk the end-effector 14. This sudden jerk can cause the box to be dropped. In summary, the operator's motion during the lifting operation is impeded due to unnecessary slack in the line 13; and the box may be dropped due to the sudden change in the line's condition from slack to tight.

The slack in the line can have far more serious consequences than slowing down the workers at their jobs; the slack line may wrap around the operator's neck or hand. As stated earlier, after the slack is produced in the line, when the operator pushes upwardly on the handle, the slack line may become tight around the operator's neck or hand creating serious or even deadly injuries. It is therefore important to ensure that the line 13 will never become slack.

In accordance with another aspect of this invention, when the operator pushes the end-effector handle 16 downward to ensure tight engagement between the suction cups 18 and the box 25, the actuator does not unwind the line 13. In other words, the device described here has the "intelligence" to recognize that the operator is simply pushing downwardly to engage the box with the suction cups 18 and he does not intend to move his hand further downward. On the other hand, if the operator pushes against the end-effector handle 16 downwardly when there is no box to resist the motion of the end-effector, the actuator of this invention will unwind the line 13 to ensure that the downward operator motion is not impeded. The assist device described here is able to differentiate between these two cases; in the first case the actuator does not unwind the line 13, while in the second case the actuator does unwind the line 13.

In order to prevent the slack in the line 13, one needs to detect the line tensile force ($f_R$). Then, with the knowledge of the line tensile force, one needs to adjust the pulley speed so rope is not unwound unnecessarily, and therefore slack is prevented in the line. In its simplest form, to prevent slack in the line, when ($f_R$) becomes zero the actuator and pulley must be stopped. In a more sophisticated form, to prevent slack in the line, smoothly, as the tensile force in the line, ($f_R$), approaches zero, the pulley rotational speed must be forced to approach zero and in the limit when a zero tensile force is registered in the controller for the line, the pulley rotational speed must be forced to zero. In other words the slack in the line is prevented by appropriately reducing the pulley speed to zero when tensile force is zero.

Previously, I stated that the pulley speed depends on the signal representing the operator force only. However for the device that will not create slack in the line, the pulley speed depends on the signal representing the line tensile force in addition to the signal representing the operator force on the end-effector handle. Two methods are preferred for detecting the rope tensile force. The first method involves the direct detection of the rope tensile force while the second method estimates the rope tensile force based on measurement of the power consumed by the actuator or the electric current used in actuator. Knowledge of line tensile force can then be used to force the actuator and pulley to have zero speed so slack is prevented in the line.

Figure 7A:
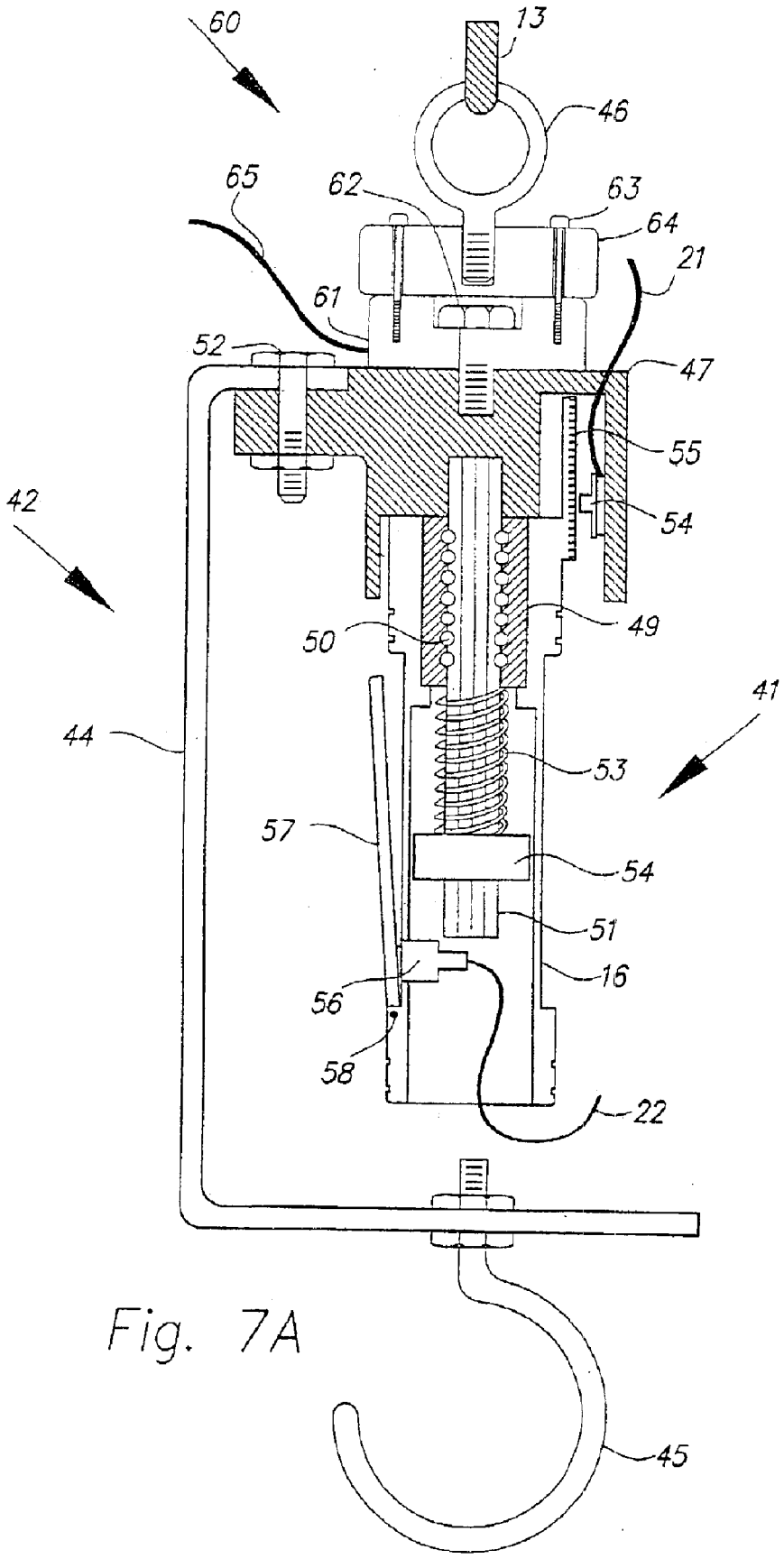
FIG. 7A illustrates a partially cross-sectioned view of one embodiment of an end-effector that includes a displacement detector for measuring the force imposed on the end-effector by an operator and a force sensor for measuring the line tensile force.

In direct detection of the line tensile force, a force sensor can be used to directly measure the line tensile force. FIG. 7A shows an end-effector 60 having a force sensor 61 installed on the end-effector between the end-effector 60 and line 13. Screw 62 is used to install the force sensor 61 to bracket 47 of the end-effector. A set of screws 63 is used to connect bracket 64 to force sensor 61. Eyelet 46 is screwed to bracket 64 and provides an interface to line 13. The force between line 13 and the end-effector 60 passes through the force sensor 61 and therefore the force sensor 61 always measures the line tensile force. Signal cable 65 carries a signal representing the line tensile force to the controller 20.

Figure 7B:
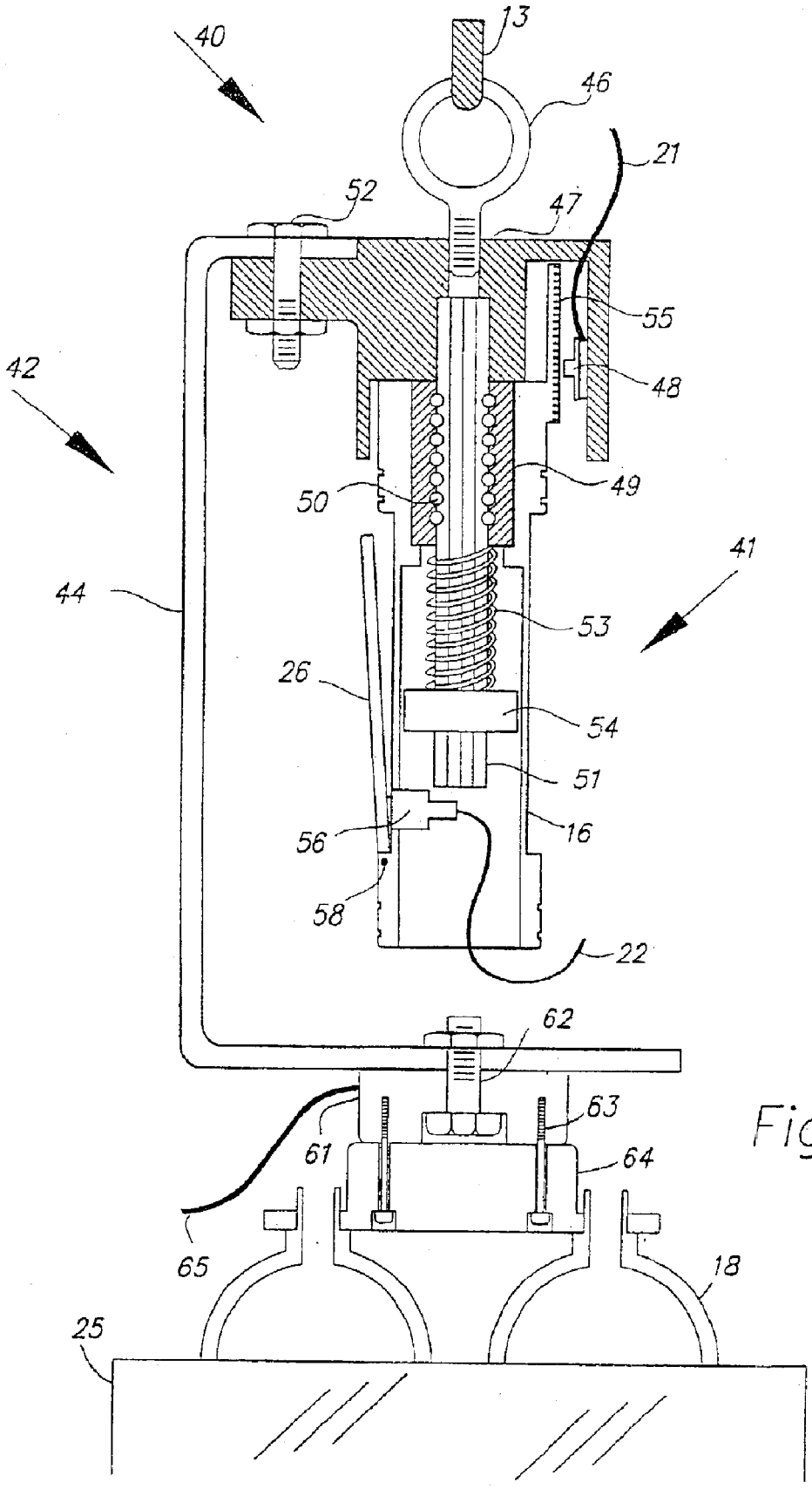
FIG. 7B illustrates a partially cross-sectioned view of one embodiment of an end-effector that includes a displacement detector for measuring the force imposed on the end-effector by an operator and a force sensor for measuring the force associated with the weight and acceleration of the load only.

Alternatively, a force sensor can be installed on the end-effector to measure the force associated with the load only as shown in FIG. 7B. Force sensor 61 is connected to part 44 via screw 62. A set of screws 63 is used to connect bracket 64 to force sensor 61. Suction cups 18 are connected to bracket 64 and provide an interface to box 25. In this case force sensor 61 always measures a force that is equal to the weight and inertia force due to acceleration of the load only. Signal cable 65 carries a signal representing this force to the controller 20 and therefore the force representing the weight and inertia force of the load (labeled as $p_L$) will be identified in the controller. Measurement of $p_L$ and f in conjunction with calculation (or direct measurement) of end-effector acceleration leads to calculation of the line tensile force, ($f_R$), according to equation (16):

$$f_R = p_L + f + W_E\left(1 - \frac{1}{g}\frac{d}{dt}v\right) \tag{16}$$

where $W_E$ is the weight of the end-effector itself and is known in advance. For maneuvers with low acceleration, the force measured by the sensor is always a tensile force (e.g. a positive value) as long as the line is not slack. The moment the load and the end-effector encounter an obstruction blocking downward movement, the sensor shows a compressive force (e.g. a negative value). This change of sign during the measurement of $p_L$ flags the existence of zero line tensile force. Also note that since the load force ($p_L$) is typically greater than operator-applied force (f), one can roughly estimate tensile force ($f_R$) by ignoring f in equation 16. Finally for maneuvers with low acceleration, the line tensile force is approximately equal to the sum of the weight of the end-effector and the weight of the load. Here I recommend that practitioners make sure equation 16 is truly satisfied in using any signal in flagging the zero line tensile force.

A force sensor suitable for use in this invention can be selected from a variety of force sensors that are available in the market, including piezoelectric based force sensors, metallic strain gage force sensors, semiconductor strain gage force sensors, Wheatstone bridge-deposited strain gage force sensors, and force sensing resistors. Regardless of the particular type of force sensor chosen and its installation procedure, the design should be such that the force sensor allows an estimation of load force or line tensile force with reasonable accuracy.

Figure 8:
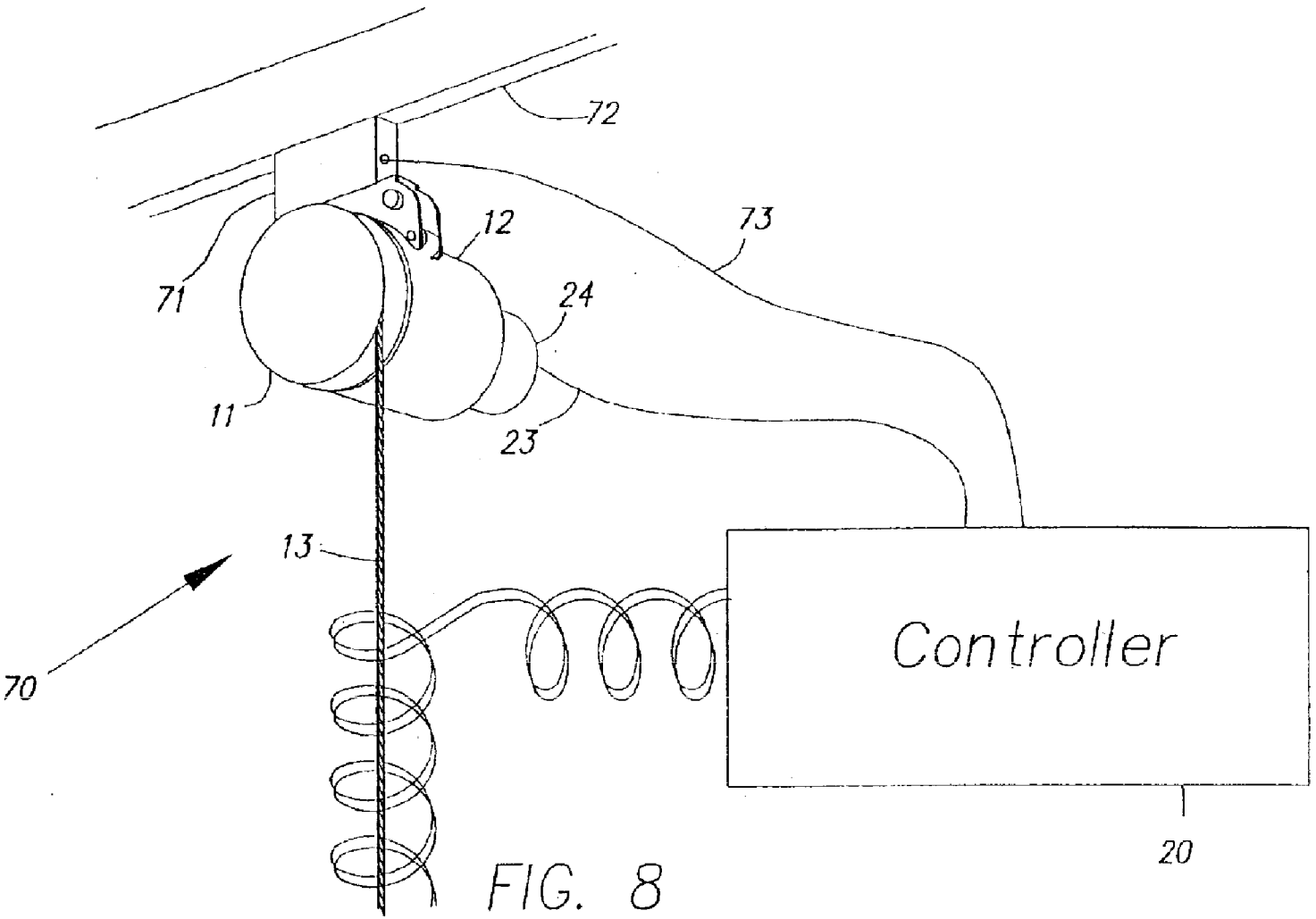
FIG. 8 schematically illustrates how a force sensor can be used to measure the entire force that the human power amplifier imposes on a ceiling or on an overhead crane.

Alternatively, one can install a force sensor directly between the actuator 12 and the rail or trolley as shown in the human power amplifier 70 of FIG. 8. Force sensor 71 measures the entire force being imposed on the rail 72 by the lifting device. A signal representing the measured force is sent to the controller 20 via a signal cable 73. When the line tensile force is zero, then the force sensor output signal represents the weight of the actuator, pulley, brake and all the components connected to the rail 72. This value can be measured and saved in the controller memory in advance. When the line tensile force is not zero, the force sensor output signal increases to include the line tensile force. Therefore, by subtracting a constant value (saved value in the memory) from the force sensor output signal, one can detect the line tensile force.

Figure 9:
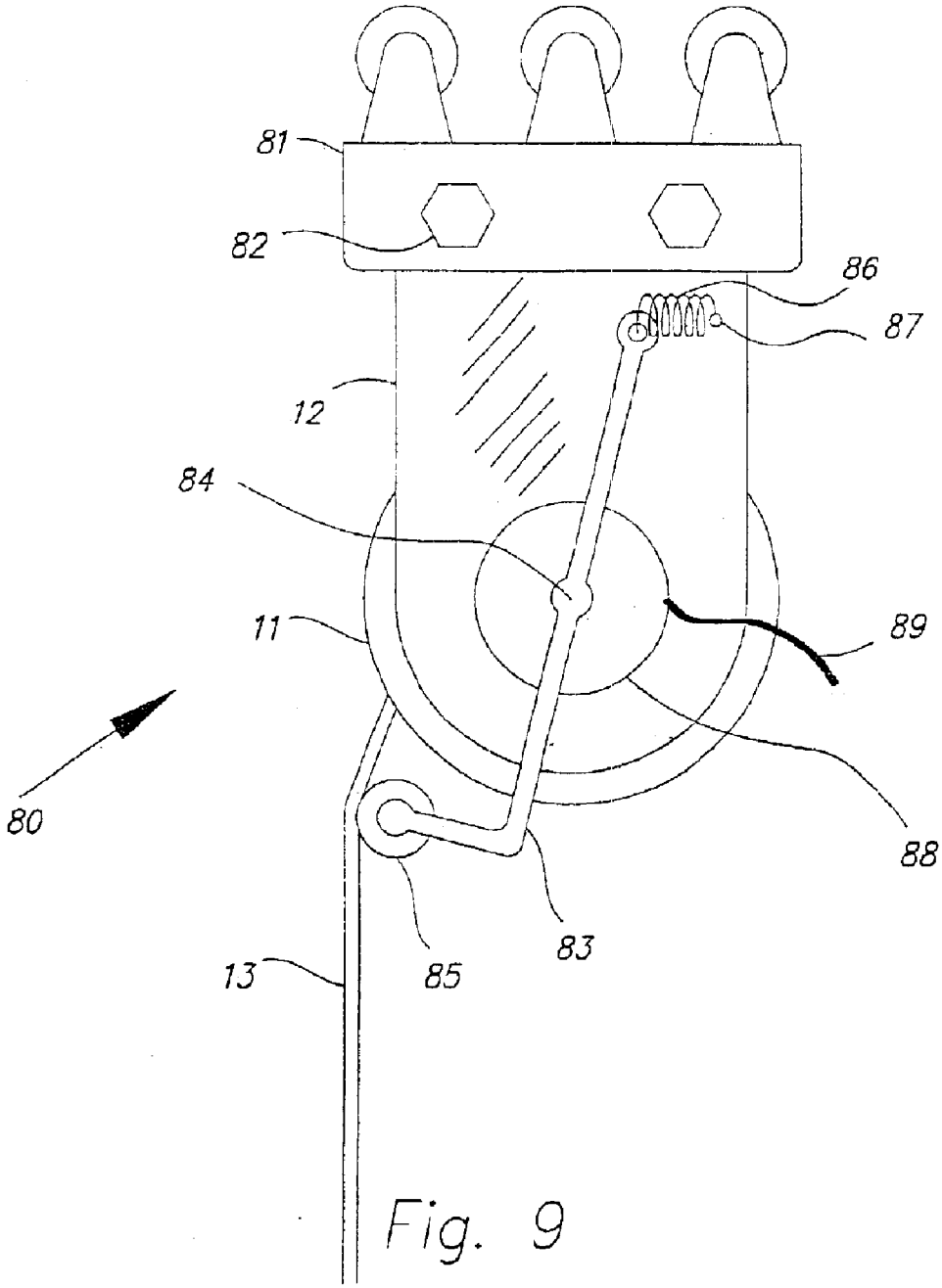
FIG. 9 schematically illustrates one embodiment of an actuator that contains a mechanism and a motion sensor to measure the line tensile force.

FIG. 9 shows how a motion sensor or estimator can be used to measure the line tensile force. Rope 13 is wound on pulley 11, and actuator 12 is connected to trolley 81 via bolts 82. Bar 83 is free to rotate around point 84 on the actuator body and holds an idler pulley 85 on one end and connects to a tensile spring 86 on its other end. The tensile spring 86 is anchored to the actuator body at point 87. The idler pulley 85 is pushed against line 13 via the force of spring 86. The rotation of bar 83 is measured by angular motion sensor 88. One can use variety of motion sensors such as optical encoder, resolver, or a potentiometer to measure the rotation of bar 83 relative to the actuator body. The larger the line tensile force is, the more bar 83 turns in the anti-clockwise direction. For small values of the line tensile force; the bar 83 turns in the clock wise direction due to force of the tensile spring 86. Signal cable 89 carries the motion sensor output to the controller. One can calibrate the output signal of the motion sensor 88 to measure or estimate the value of the line tensile force. Instead of transforming the tensile force to rotational motion one can transform the line tensile force into linear motion. This can be accomplished by installing the idler pulley on a bar that has translational movement. Then a linear potentiometer, a linear encoder or an LVDT can be used to detect this linear motion.

Figure 10A:
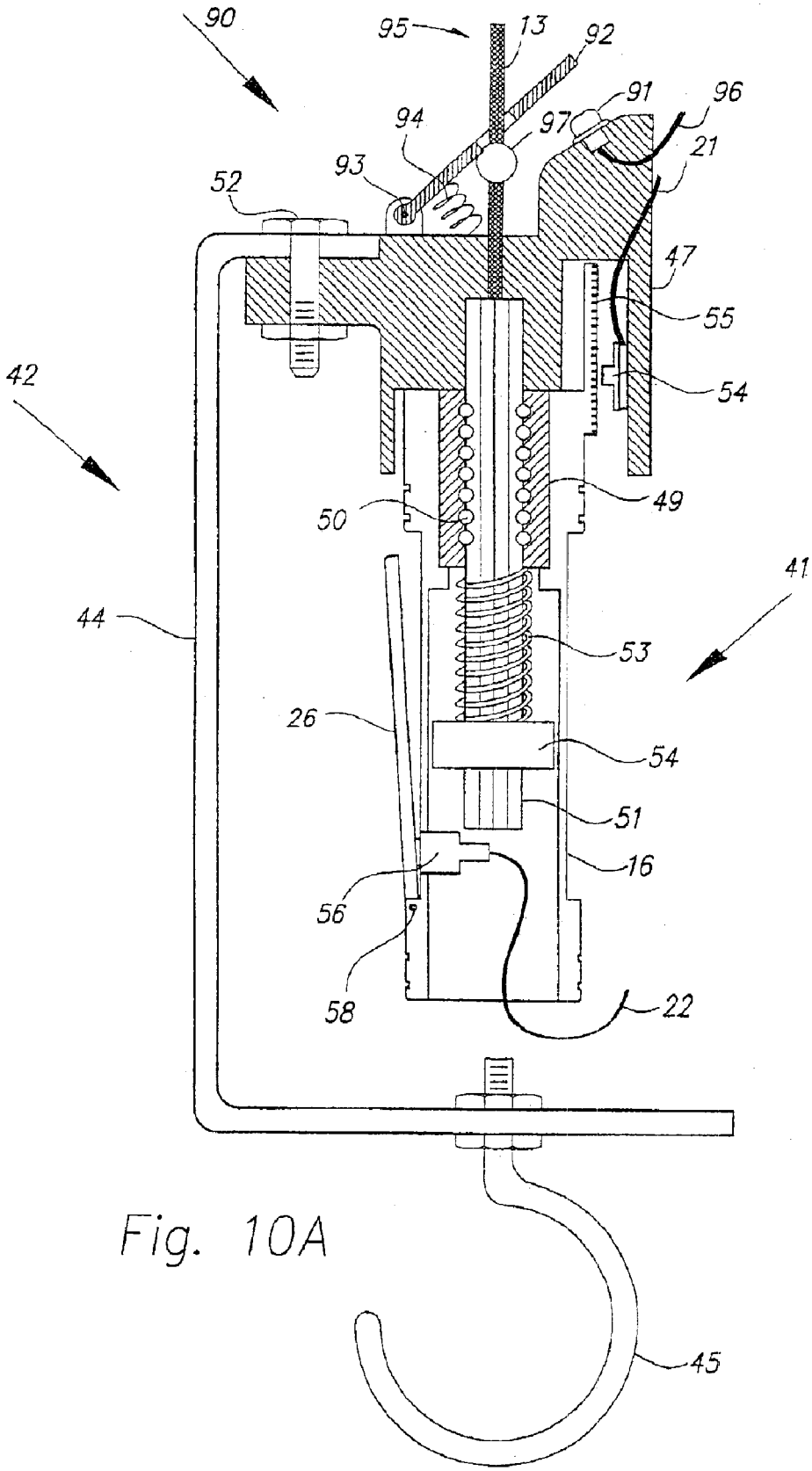
FIGS. 10A and 10B illustrate partially cross-sectioned views of one embodiment of an end-effector that includes a displacement detector for measuring the force imposed on the end-effector by an operator and a mechanism for detecting the line tensile force.
Figure 10B:
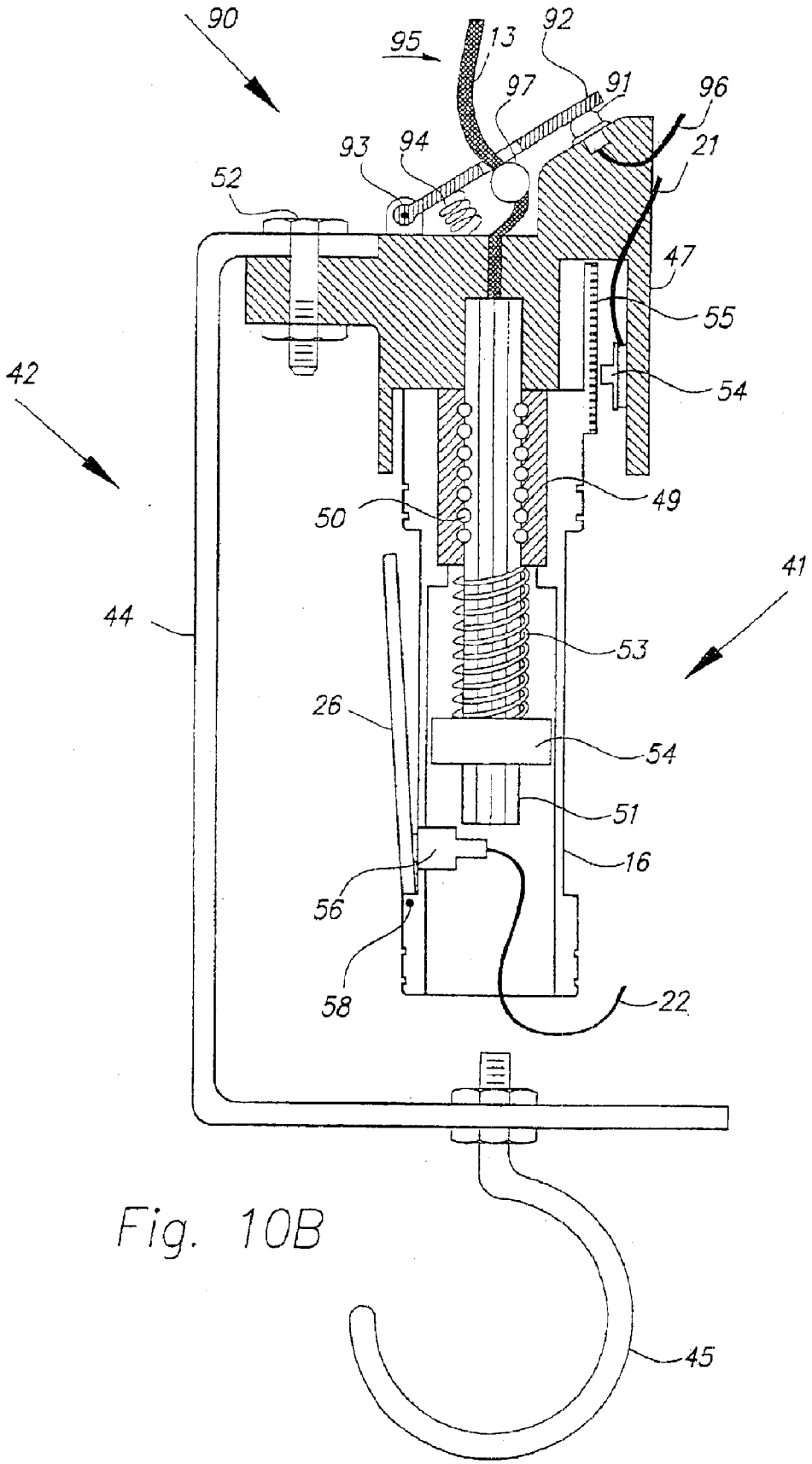

Rather than generating a signal representing the line tensile force magnitude, one might be interested in a detection device that generates a binary signal; one signal when the line tensile force is zero and another signal when the line tensile force is not zero. These devices have lower cost since they give limited information about the rope tensile force. FIG. 10A and FIG. 10B show an end-effector 90 having a tensile force detector comprising a momentary switch 91, mounted on bracket 47, for generating a binary signal. Rope 13 is firmly connected to bracket 47, plate 92 is able to rotate along hinge 93. Tensile spring 94 is connected between plate 92 and bracket 47 causing plate 92 to rotate along the direction of arrow 95. Plate 92 also has a hole that allows the rope 13 to pass through. A signal cable 96 carries the momentary switch output to the controller. Stop 97, preferably a plastic sphere is rigidly connected to rope 13. Stop 97 does not allow plate 92 to rotate along the arrow direction 95 when the line tensile force is non-zero (FIG. 10A). In fact in the presence of a non-zero tensile force in the line 13, stop 97 causes plate 92 to be at the position shown in FIG. 10A not pressing against switch 91. When the line tensile force is zero (as shown in FIG. 10B), plate 92 pushes against switch 91 by the force of a spring 94. Therefore this limited force detecting device detects that tensile force exists in the rope, but is not able to measure the magnitude of the rope tensile force. Basically, this method uses the tensile force in the line to create a binary electric signal, representing the presence or absence of line tensile force for the controller; one signal when the line tensile force is non-zero and another signal when the line tensile force is zero.

Figure 11B:
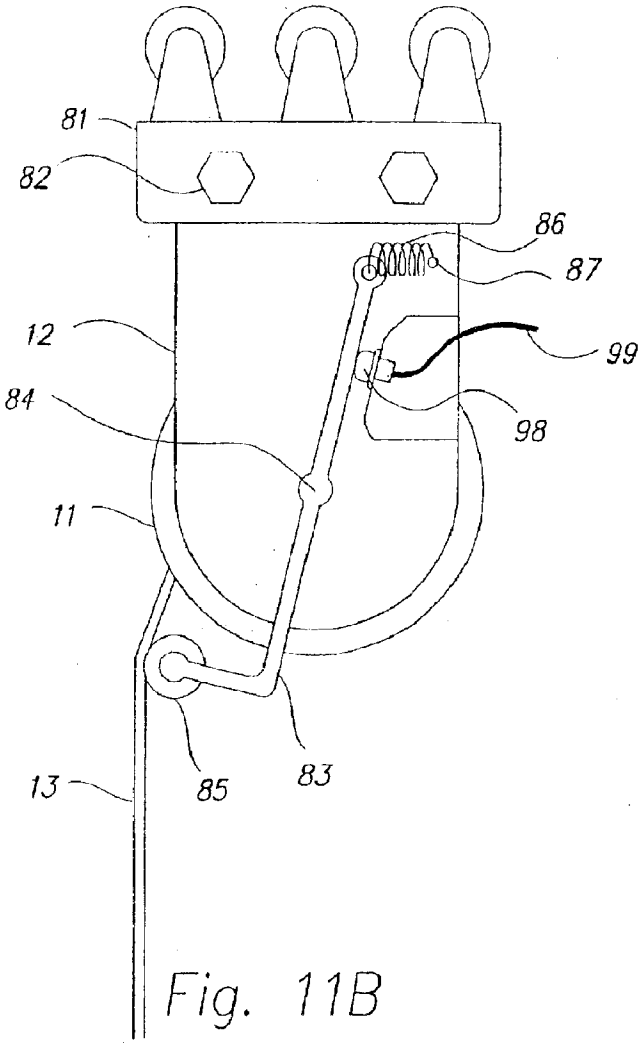
FIGS. 11A and 11B illustrate one embodiment of an actuator that contains a mechanism and a switch to detect the line tensile force.
Figure 11A:
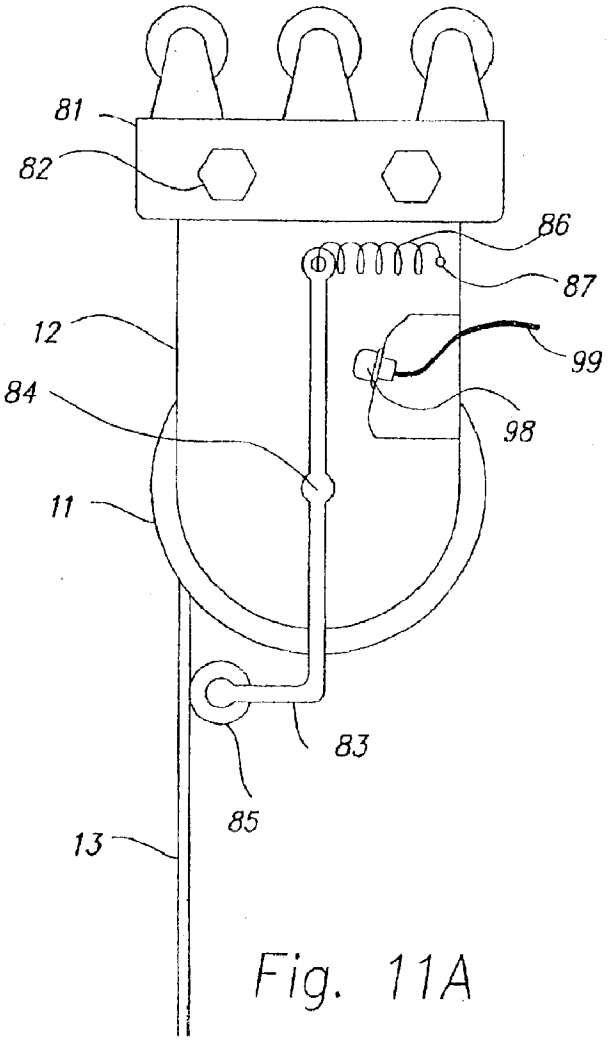

Alternatively, one might be interested in employing the rope tensile force at another location on the rope to detect the presence of line tensile force. This is shown in FIG. 11A and FIG. 11B where line tensile force, at the top of the device near the actuator 12, is employed to generate a binary signal for the controller. Line 13 is wound on pulley 11, and actuator 12 is connected to trolley 81 via bolts 82. Bar 83 is free to rotate along point 84 on the actuator body and holds an idler 85 on one arm and connects to a tensile spring 86 on its other arm. The tensile spring 86 is anchored to the actuator body at point 87. The idler 85 is pushed against rope 13 via the force of spring 86. When the rope tensile force is not zero as shown in FIG. 11A, the rope tensile force overcomes the spring force and causes bar 83 to be separated from switch 98. When the rope tensile force is zero as shown in FIG. 11B, the idler 85 is pushed toward left by the force of the tensile spring 86. This causes switch 98 to be activated by bar 83. Therefore, a signal is generated by the switch when the line tensile force is zero. Signal cable 99 carries the momentary switch output to the controller. Instead of transforming the tensile force to rotational movement as shown in FIG. 11A and FIG. 11B, one can transform the line tensile force into linear motion. This can be accomplished by installing the idler pulley 85 on a bar that has translational movement and is supported on a linear bearing. The idler pulley is in contact with the line 13 and the tensile force in the line causes transnational movement for the bar. The movement of the bar, in return, causes a switch 98 to be activated.

Figure 12A:
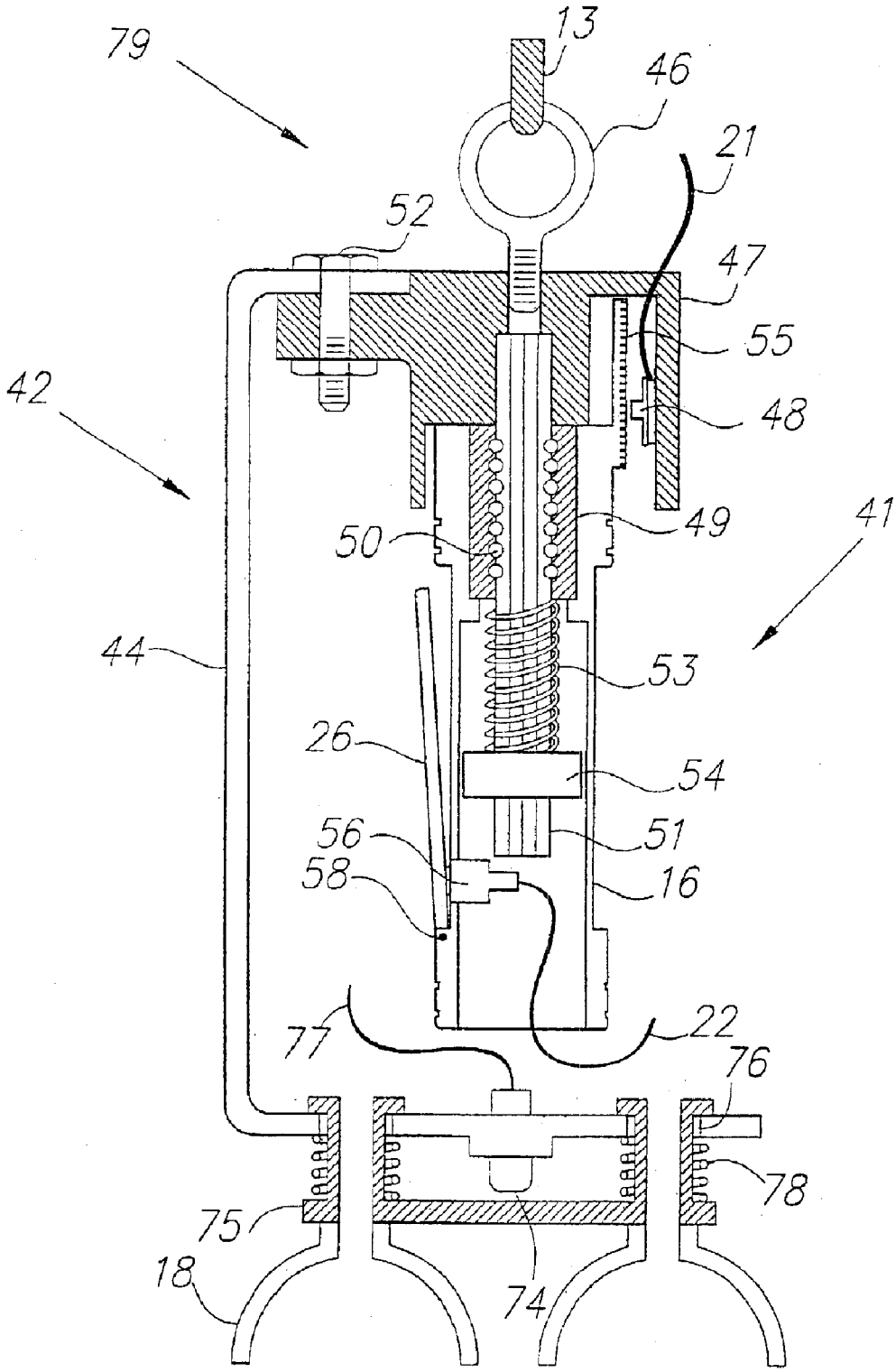
FIGS. 12A and 12B illustrate one embodiment of an end-effector that includes a displacement detector for measuring the force imposed on the end-effector by an operator and a switch that transmits a signal when the end-effector is constrained from moving downwardly.
Figure 12B:
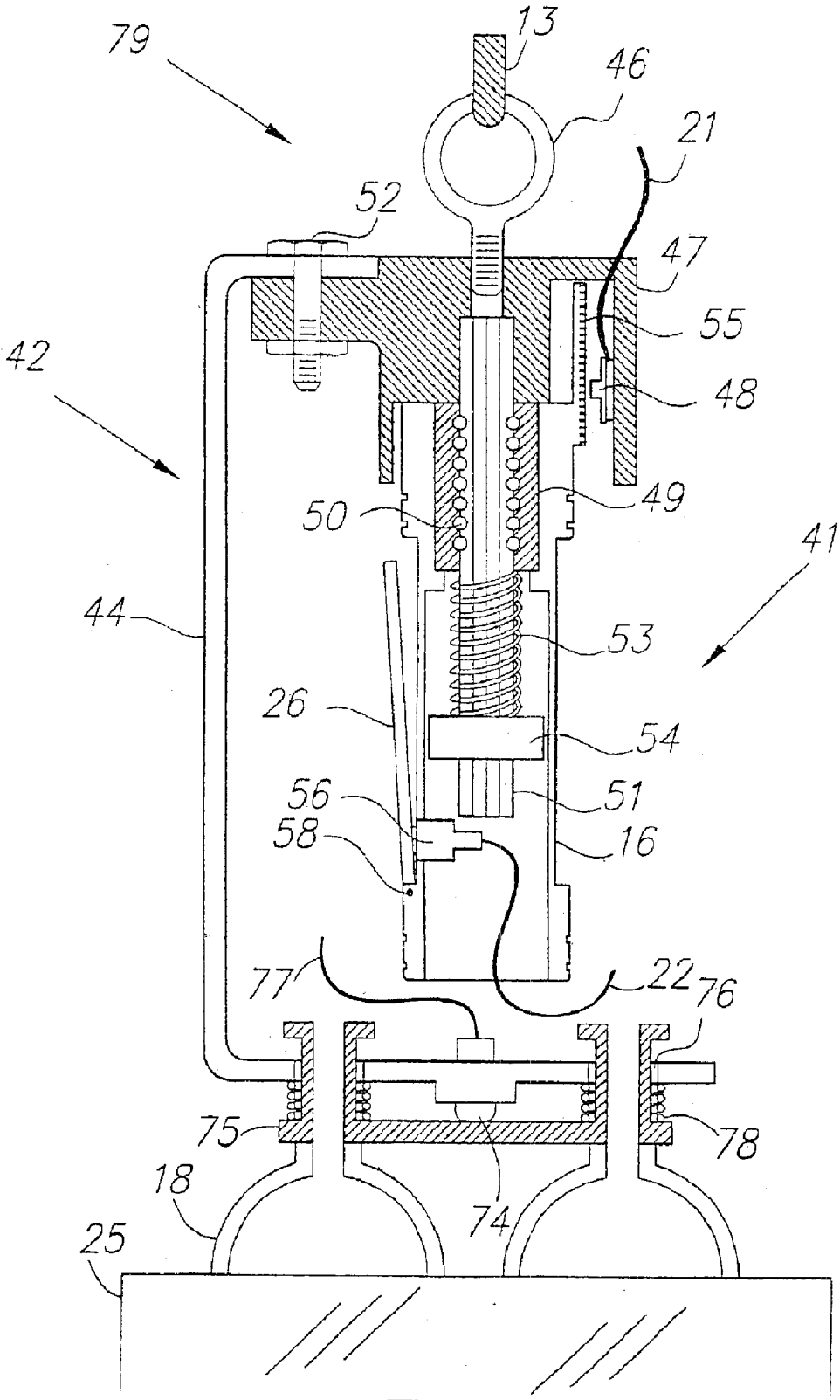

Another preferred method of detecting the status of the line tensile force involves instrumentation of the end-effector 79 with a switch as shown in FIG. 12A and FIG. 12B. Switch 74 is preferably installed on a horizontal section of bracket 44. Bracket 75 holding two suction cups 18 is free to slide in the vertical direction relative to part 44. Slots 76 are provided in part 44 as bearing surfaces for sliding motion of part 75 relative to part 44. FIG. 12A shows the end-effector 79 where the end-effector is not constrained by any object from moving downwardly and switch 74 is not pressed. Optional compression springs 78 are installed between bracket 75 and part 44 to maintain a distance between part 44 and bracket 75. When the end-effector is lowered (FIG. 12B), and part 75 is prevented from going downwardly by box 25, this causes switch 74 to be pressed by part 75 generating an electric signal. At this moment, the entire force associated with the weight and inertia of the end-effector, and the operator force (shown by the right hand side of equation 16) are supported by box 25 and not by the line 13. This indicates that the line tensile force (the left side of equation 16) is zero. Therefore, the signal generated by switch 74 determines not only the existence of the obstruction, but also the existence of zero tensile force on the line. Therefore, the sensory system of FIGS. 12A and 12B is not only an obstacle detector, but also a tensile force detector. This signal is carried to the controller 20 by the signal cable 77 and can be used to declare the zero tensile force in the line. When there is no object to prevent the downward motion of the end-effector, then part 75 is lowered either by its own weight or by the force of compression springs 78 releasing switch 74. Therefore, this end-effector is able to create a binary signal, one when the force in the line is zero and another one when the force in the line is not zero.

A second preferred method estimates the line tensile force based on the current or energy consumed by the actuator to support the end-effector and any load connected to it on the line. The energy consumed by the system to support the end-effector and a load connected to it can include many different types of energy including electric, pneumatic, hydraulic, and other alternative types of energy. If pneumatic or hydraulic actuators are used in the system, then the load pressure in the actuator can be used to estimate line tensile force. In a specific preferred embodiment line tensile force can be determined by measuring the current in the electric actuator, since the current in the electric actuator is related to the tensile force in the line. Moreover, measuring the current used in the electric actuator is a cost-effective approach in estimating the line tensile force since measurement of electric current is usually available in many of the electronic amplifiers that drive the electric actuators. Even if the current measurement is unavailable in the electronic amplifier for the motor, one can use a clamp-on current sensor to measure the current that is used by the motor. The clamp-on current sensor can be installed on any part of the cable that powers the electric actuator 12. The clamp-on current sensor is essentially a Hall effect sensor that detects the magnetic field strength around a wire, which is proportional to the electric current flow. In a preferred embodiment of this invention, the amplifier that powers the electric motor has a built-in sensor to measure the current drawn by the electric motor of the actuator 12 and thereby estimates line tensile force.

Figure 13:
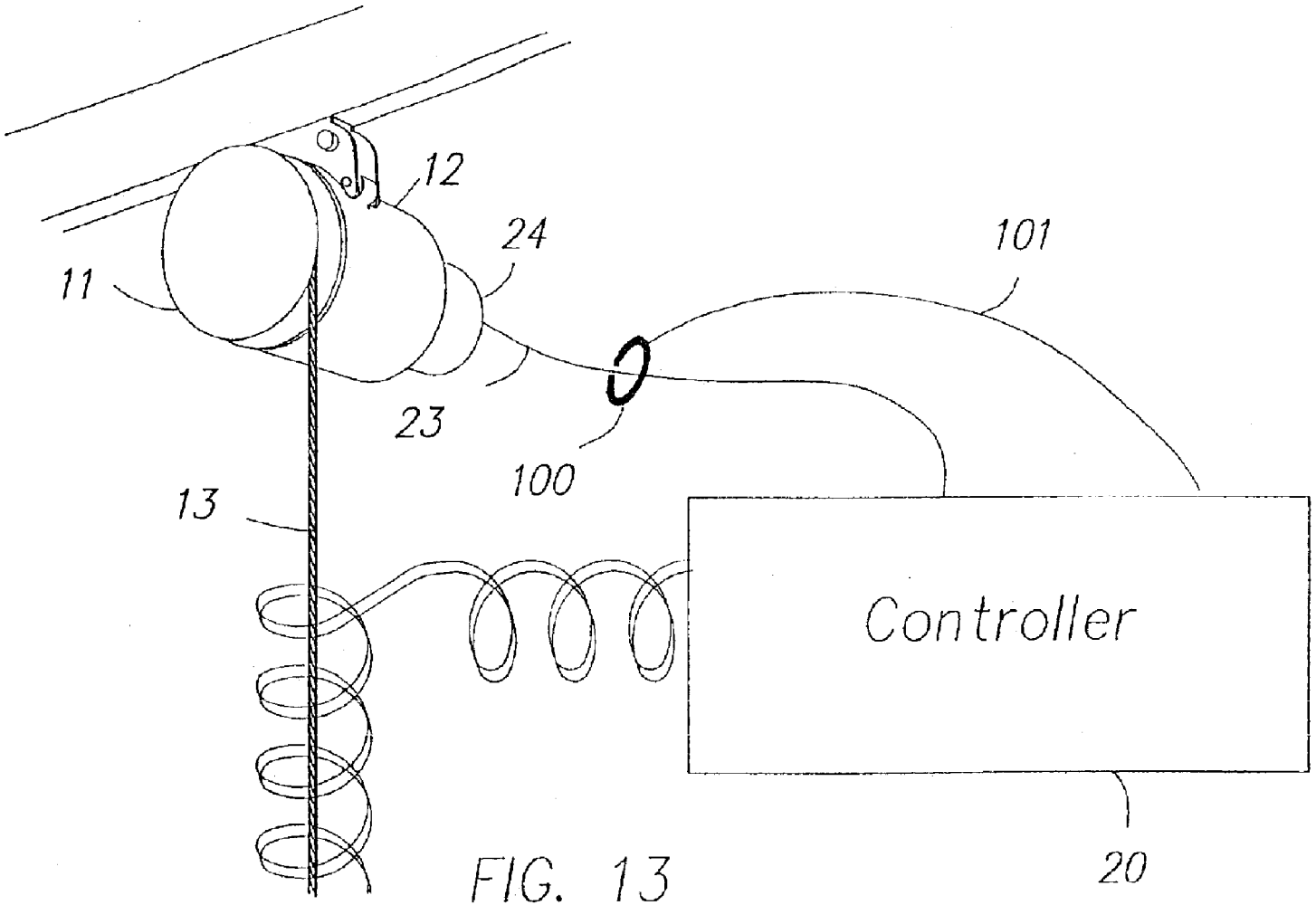
FIG. 13 illustrates how a clamp-on current sensor can be used to detect the current drawn by the actuator.

FIG. 13 shows the inventive assist device with a clamp-on current sensor 100 used to detect the current used in the actuator. The current from the power supply in controller 20 to actuator 12 is carried by a cable 23 and the signal representing the measure of the electric current used by the motor is sent to the controller via signal cable 101. I will explain later how the current measurement can be used to detect or estimate the line tensile force, but I will first explain how the knowledge about the rope tensile can be used to prevent slack in the line.

Figure 14:
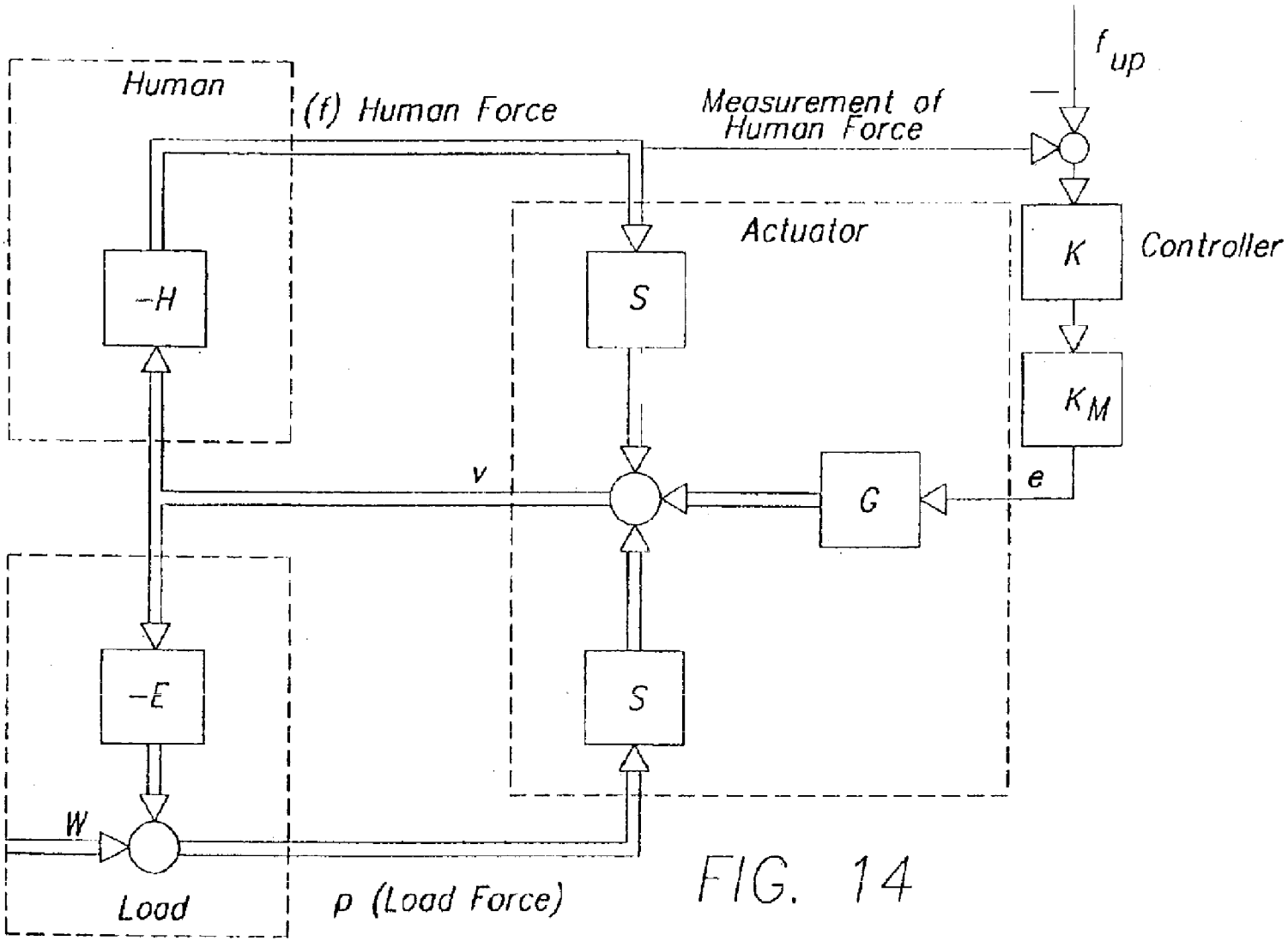
FIG. 14 schematically illustrates operator-applied forces and load forces interacting with elements of a human power amplifier to move a load while slack in the line is prevented.

Once the tensile force in the line is measured or estimated via the methods described above, the actuator speed must be modified according to the measured or estimated line tensile force. If the line tensile force is zero, then the input to the actuator should be modified to generate zero speed in the actuator so no extra line is unwounded. This can be done by introducing variable $K_M$ into the control block diagram, as shown in FIG. 14. If the transfer function of the controller is represented by (K), then the output of the controller (e) is:

$$e=K_M K(f-f_{up}) \tag{17}$$

Inspection of FIG. 14 shows that the line velocity can be represented by equation (18):

$$v=GK_M K(f-f_{up})+S(f_R) \tag{18}$$

where $K_M$ is a variable such that $K_M=1$ when the line tensile force, ($f_R$) is non-zero. Substituting $K_M=1$ in equation (18) results in equation 19 when the line tensile force is non-zero:

$$v=GK(f-f_{up})+S(f_R) \tag{19}$$

Equation 19 is similar to equation 6, and therefore it states that the behavior described previously by three experiments are still valid. When the rope tensile force ($f_R$), is detected to be zero via any of the methods described above, ($K_M$) must be changed to a zero value. Substituting zero for ($f_R$) and ($K_M$) in equation (18) results in a zero value for line speed (v). This means that no line will be unwound and slack in the line will be prevented when ($f_R$) is detected to be zero. For instance, when an operator is moving the end-effector downwardly, either with or without a load connected to it, tensile force on the line will be a non-zero value. If the operator brings the end-effector into contact with an obstruction that results in the weight of the end-effector (and any load connected to it) being supported by that load or obstruction, tensile force on the line will go to zero. While operator-applied force may be detected and may cause line to be paid out momentarily, the instant the line is no longer taut (i.e. tensile force is zero), the operator-applied force (f) no longer contributes to line motion and slack is prevented.

Although I prefer to program the system to prevent slack by evaluating tensile force, there are other ways to prevent slack in the line. An alternative method in detecting the slack in the line during quasi static operation (low accelerations and decelerations maneuvers) involves simultaneous evaluation of operator-applied force (f) and tensile force ($f_R$) to detect whether or not the end-effector is supported by the line. The first step is to calibrate the system before operation to evaluate the tensile force on the line derived solely from the weight of the end-effector ($W_E$). During operation, the value of operator-applied force (f) on the end-effector and the tensile force ($f_R$) on the line are simultaneously evaluated. Then, by subtracting the value of the operator-applied force (f) from tensile force ($f_R$), the controller can isolate load force (p) using equation (3). Finally, by comparing the value of (p) to the stored value ($W_E$) the controller can determine whether or not the end-effector is being supported by the line. As long as the load force (p) is approximately equivalent to the weight of the end-effector ($W_E$), the system will know that the end-effector is neither engaged with a load nor supported by an obstruction and that it is safe to pay out line. If at any moment the load force (p) is not at least equal to the weight of the end-effector ($W_E$), the system will know that the end-effector is supported by some obstruction and will adjust actuator speed to zero to prevent slack in the line.

Figure 15A:
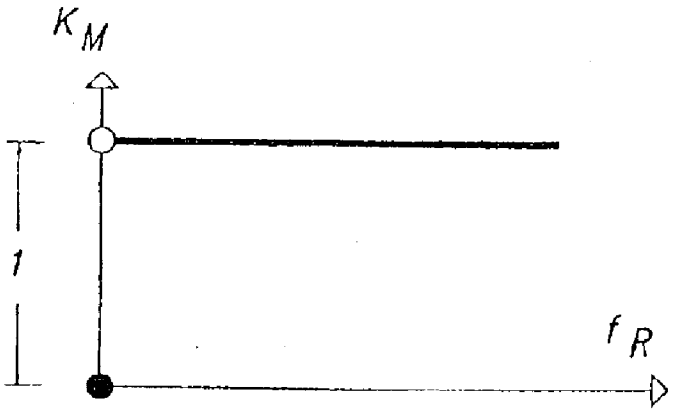
FIGS. 15A, 15B, 15C and 15D graphically show values of a control variable $K_M$ as a function of the tensile force in a hoist line.

The variation of ($K_M$) as a function of ($f_R$) is shown graphically in FIG. 15A where ($K_M$) changes from one to zero when the rope tensile force changes from a non-zero value to zero. When zero tensile force in the line has been detected, the actuator speed will become zero and the actuator will not unwind the line. It is important to make sure that the system can come out of the slack control when the operator initiates an upward motion on the end-effector. However, since $K_M$=0, the upward motion of the operator will not create any tensile force on the line to end the slack control mode if FIG. 15A is used to model ($K_M$) at all times. This implies that the use of plot 15A forces the system to prevent slack, but the system cannot come out of the slack control.

Figure 15B:
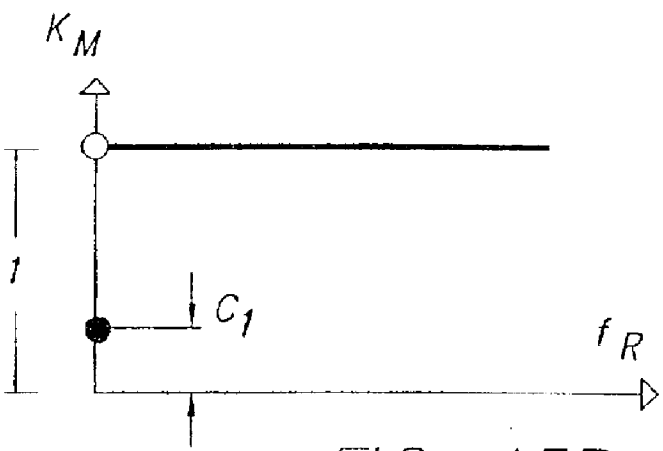

To cure this problem, we use the plot of FIG. 15B when the signal representing the operator force indicates upward motion and plot of FIG. 15A when the signal representing the operator force indicates downward motion. The plot of FIG. 15B has a non-zero value of $C_1$ for ($K_M$) when the line tensile force is zero. The non-zero value of ($K_M$) results in a non-zero, but small value for the actuator speed when the upward motion is initiated by the operator. This causes the system to come out of slack control and results in the end-effector being lifted when the operator initiates an upward motion. One can use a variety of functions to create a smooth transition between the values of ($K_M$).

Figure 15C:
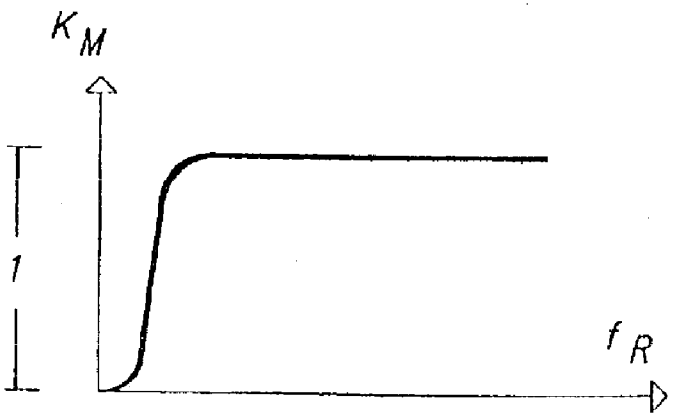
Figure 15D:
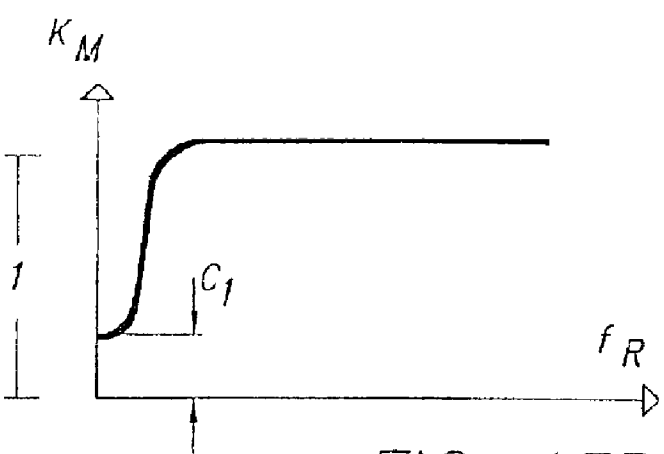

If a force detection device gives a complete measurement of the line tensile force (e.g. FIG. 7A, FIG. 7B, FIG. 8, FIG. 9, and FIG. 13), then FIG. 15C can be used to represent variation of ($K_M$) as a function of line tensile force when the signal representing the operator force on the end-effector indicates a downward motion. The smooth transition between the two values of ($K_M$) as a function of rope tensile force leads to less jerky motion for the device. FIG. 15D shows the variation of ($K_M$) as a function of line tensile force when the signal representing the operator force on the end-effector indicates an upward motion. Note that the non-zero value of $C_1$ for ($K_M$) when the line tensile force is zero ensures that the system will come out of slack control when the signal representing the operator force on the end-effector indicates an upward motion. One can use a variety of mathematical functions to represent the plot of FIGS. 15C and 15D. For example, equation (20) is a good candidate to mathematically present the plot of FIGS. 15C and 15D:

$$K_M = 1 - (1 - C_1)\, e^{-\frac{f_R^2}{C_2}} \tag{20}$$

where $C_1$ is a non-zero value, but smaller than unity, when the signal representing the operator force on the end-effector indicates an upward motion. Equation (20) results in the plot of FIG. 15C if $C_1$ is chosen to be zero. $C_2$ can be chosen to yield an appropriate slope for the plot. Large values for $C_2$ result in a larger slope for the plot of equation (20). In one embodiment $C_1$ and $C_2$ were chosen to be 0.4 and 600, respectively. The variation of ($K_M$), as shown in FIGS. 15A, 15B, 15C, and 15D, can be programmed in controller 20. One can also use a look-up table to generate numerical values of ($K_M$).

Slack prevention upon detection of zero line tension can be used to prevent only pay out or unreeling of line without effecting reeling in of line. Then an upward force signal from an operator can be acted on by winding line upward even though line force is zero when the upward signal occurs.

Figure 16:
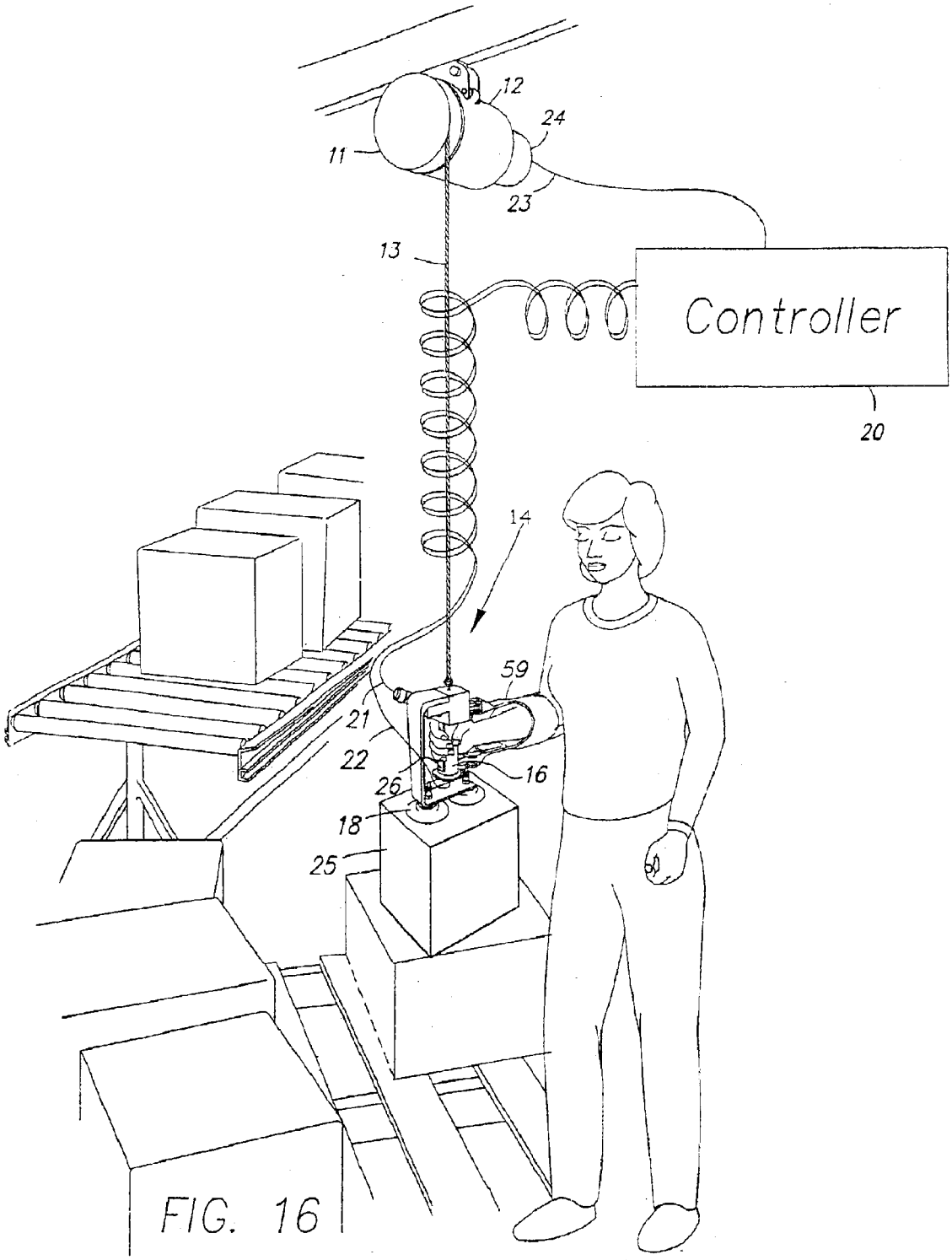
FIG. 16 illustrates one embodiment of a human power amplifier that prevents slack in the line even when the end-effector is pushed downwardly by the operator while the end-effector is constrained from moving downwardly.

FIG. 16 illustrates an embodiment of the invention that offers slack prevention and can be used for depalletizing. As can be seen in FIG. 16, the line does not become slack if the end-effector is pushed downwardly by the operator while the end-effector is constrained from moving downwardly. End-effector 14 is connected to electric actuator 12 mounted on the ceiling or on an overhead crane. As the shaft rotates the pulley, the pulley's rotation winds or unwinds the line 13 and causes the line 13 to lift or lower the end-effector 14 and box 25. Two suction cups 18 are used to engage the box 25 to the end-effector 14. The actuator 12 is controlled by the electronic controller 20. The computer located in controller 20 receives two signals: one signal from end-effector 14 over signal cable 21, representing the operator force, and a second signal from a current sensor, representing electric current drawn by the actuator 12. The signal representing the current drawn by the actuator 12 is not shown in FIG. 16 since in this embodiment of the invention the available current sensor is in the power amplifier (located in controller 20) that powers the electric actuator 12. The computer in controller 20 sets the speed that pulley 11 has to turn, based on two signals representing the operator force on the end-effector 14 and the tensile force in line 13. The controller 20 powers the actuator 12 via cable 23. The resulting motion of actuator 12 and pulley 11 is enough to either raise or lower the line 13 the correct distance that creates enough mechanical strength to assist the operator in the lifting or lowering the task as required. If the operator's hand pushes upward on handle 16, the pulley 11 rotates so as to pull line 13 upward, lifting box 25. If the operator's hand pushes downward on the handle 16, the pulley rotates so as to move line 13 downward, lowering box 25. However, as shown in FIG. 16, the line does not become slack if the end-effector is pushed downwardly by the operator while the end-effector is constrained from moving downwardly.

Here, I now explain how the measurement of current drawn by the actuator can be used to estimate the line tensile force if an electric actuator is used in the system. The magnitude of the torque generated by actuator 12 to turn the pulley 11 and lift the load is proportional to the current that is used in the actuator 12. This is presented by equation (21):

$$T_T=K_T I \tag{21}$$

where ($T_T$) is the total torque generated by actuator 12, (I) is the current used in actuator 12, and ($K_T$) is a proportionality constant. The value of ($K_T$) is usually supplied by the actuator manufacturer. ($K_T$) Can also be measured experimentally by measuring current drawn by the actuator for some known loads on the actuator. Although equation (21) is widely reported as the true relationship between the torque generated by the actuator and electric current drawn by the actuator, depending on the quality of the power amplifier that powers the actuator, there might be some residual current measurement when no torque is generated. The power amplifier must be calibrated to take into account this residual biased current measurement. The amount of torque available to lift the load and end-effector, $T_L$, is equal to the difference between the total torque generated by actuator 12 and the torque required to rotate pulley 11 and all rotating components of the actuator. This is presented in equation (22):

$$T_L=T_T-T_P \tag{22}$$

where $T_P$ is the torque required to turn pulley 11 and all rotating components of actuator 12. The torque $T_P$ is calculated in equation (23):

$$T_P=I_P\alpha+B_P\omega+T_o \tag{23}$$

where:

$I_P$=moment of inertia of all rotating components of the actuator (motor and transmission) and pulley as reflected on the motor shaft $B_P$=coefficient of friction of the same components above $\alpha$=angular acceleration of the electric motor shaft $\omega$=angular velocity of the electric motor shaft $T_o$=constant torque due to coulomb friction in the system Both ($\alpha$) and ($\omega$) (the angular acceleration and angular velocity of the motor shaft) can be estimated by measuring the motor shaft angle using many standard estimation techniques.

($I_P$) and ($B_P$) are two parameters associated with the actuator and can be measured experimentally. ($B_P$) represents the proportionality of the torque with the motor speed during steady state behavior (i.e. constant actuator speed). Practitioners must measure the required torque to turn the motor shaft at constant speeds. ($B_P$) is a proportionality constant between the motor steady state speed and the required torque. ($I_P$) represents the proportionality of the torque with the motor acceleration during high acceleration maneuvers. There are many ways of measuring ($I_P$) and ($B_P$) using standard parameter estimation techniques. For example, the Extended Kalman Filter is a well-known approach in parameter estimation and can be found in the control science literature. "Adaptive Control," by Shankar Sastry and Marc Bodson, Prentice Hall, 1989, and "Time Series Analysis," by George Box and Gwilym Jenkins, Hgolden-Day, 1976, are two good references in model estimation. Two simple experiments can measure $B_P$ and $I_P$.

One can measure ($I_P$) by driving the actuator with a high frequency sinusoidal input torque. At high frequencies, the torque to overcome the frictional torque is rather small in comparison with the inertial torque due to acceleration, and ($I_P$) is proportionally constant between the motor acceleration and the motor torque. By measuring the motor shaft acceleration and torque, one can arrive at a value for ($I_P$). To measure ($B_P$), one can drive the actuator with constant speed. At constant speeds the torque associated with the inertial torque due to acceleration is zero and ($B_P$) is proportionally constant between the motor speed and the motor torque. By measuring the motor shaft speed and torque, one can arrive at a value for ($B_P$).

($T_o$) is a small constant torque due to dry friction in the actuator (in particular in the transmission part of the electric actuator.) For high performance and well-lubricated electric actuators with little friction, ($T_o$) is a small quantity and can be neglected, otherwise it can be measured experimentally.

Substituting for ($T_P$) from equation (23) and ($T_T$) from equation (21) into equation (22) yields an equation for the torque required to lift the load:

$$T_L=K_T I-(I_P\alpha+B_P\omega+T_o) \tag{24}$$

By measuring the current in actuator 12 and the velocity and acceleration of the actuator shaft, one can calculate ($T_L$) from equation (24). The tensile force in the wire line, ($f_R$), is:

$$f_R=[K_T I-(I_P\alpha+B_P\omega+T_o)]/R \tag{25}$$

where R is the radius of pulley 11. For actuators that have gear heads with very large transmission ratios (non-back-driveable systems), the motor torque that supports the line tensile force is usually small in comparison with the motor torque that accelerates (or decelerates) the rotating parts of the actuator. In other words the current used to provide torque to maintain the line tensile force only constitutes a small portion of the current drawn by the electric motor if high transmission ratios are used. Moreover, actuators having low transmission ratios will yield a larger range for the current reading due to tensile force variation than of the actuators with high transmission ratios.

Note that equation (23) shows the basic and linear form of the dynamics of the actuator. If the actuator is designed properly and is well lubricated, equation (23) governs the dynamics of the system well. In instances requiring more precision, one might use equation (26) below, which is similar to equation (25) with the friction force modeled by a non-linear relation, g($\omega$):

$$f_R=[K_T I-(I_P\alpha+g(\omega)+T_o)]/R \tag{26}$$

The structure of g($\omega$) can be estimated experimentally using standard system identification techniques. Again, the Extended Kalman Filter is a well-known approach in parameter estimation and can be found in the control science literature.

The slack control methods described here were motivated based on an application of the device using the suction cups. Even if the human power amplifier device is not employed for use with the suction cups, the slack control described above is preferably implemented in the device. There are many situations when the operator can inadvertently push the load interface subsection onto various surrounding objects including the objects to be maneuvered. The downward residual force of the operator will cause slack in the line if the end-effector is prevented from moving downward. Therefore, it is important to prevent slack in the line at all times.

Figure 17:
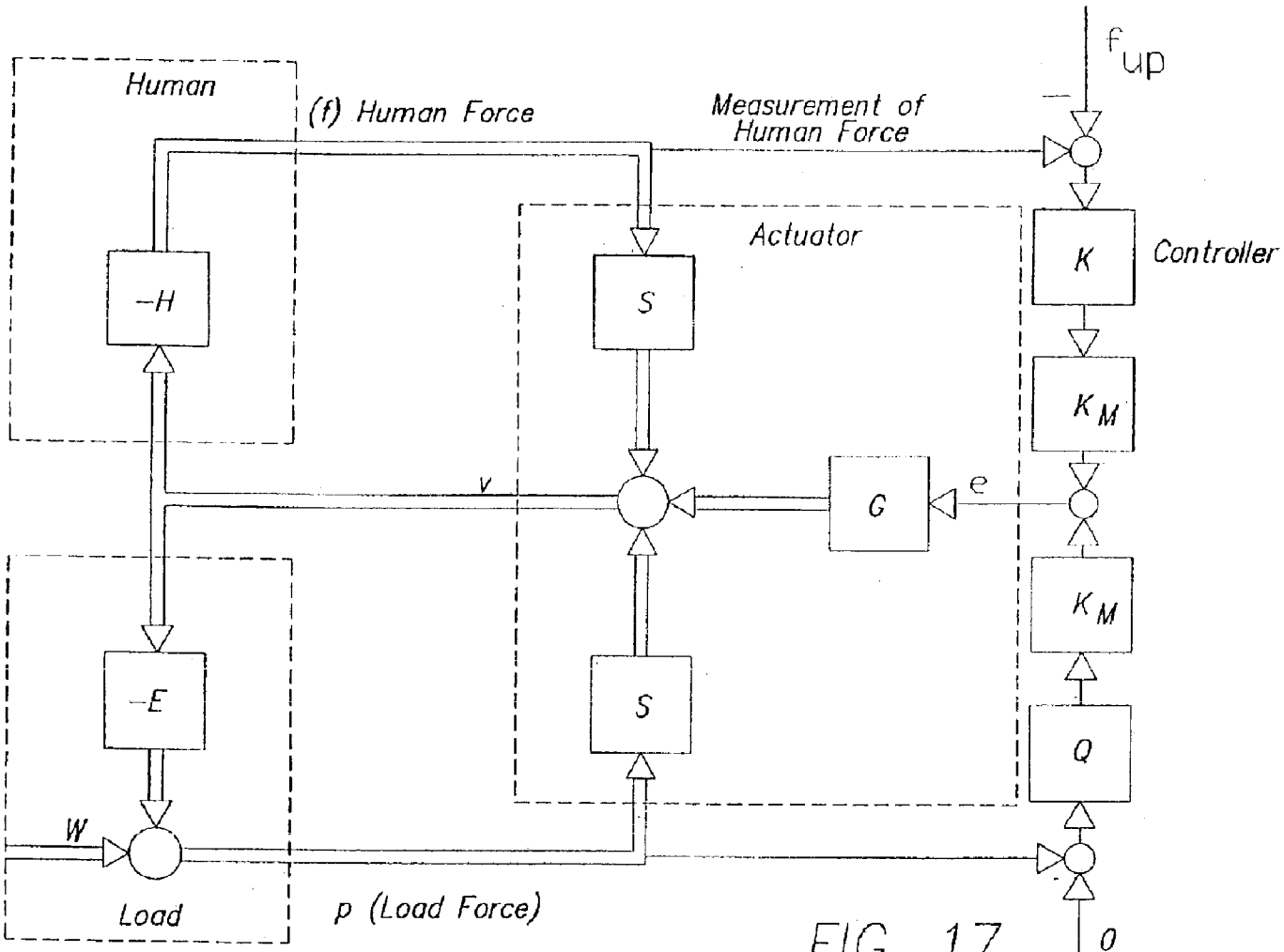
FIG. 17 schematically illustrates both human force and load force used as feedback signals to provide movement to a load while slack in the cable is prevented.

Inspection of equation (13) shows that variations in load weight, ($\Delta W$), results in a small variation in the operator force, ($\Delta f$), if (S) is a small quantity. In other words, the operator will have little feeling about the variation in the load weight if (S) is a small quantity. If the line tensile force, ($f_R$), is measured or estimated for slack prevention as discussed above, then using ($f_R$), one can further improve the system performance by creating more pronounced feeling for the operator if the load weight changes. Here I explain how this improvement can be accomplished. Once the line tensile force ($f_R$) is known, one can calculate the load force (p) from equation (3). The load force (p) can then be used as a feedback signal:

$$e=K_M K(f-f_{up})+Qp \tag{27}$$

where (Q) is a controller transfer function operating on the load force (p). Throughout this application (Q) might also be referred to as a force feedback transfer function since it feeds the load force back to the controller. A comparison of equation 17 with equation 27 indicates how both operator force and load forces are used as feedback signals in equation 27, but only operator force is used in equation 17. FIG. 17 shows the implementation of equation 27. Substituting (e) from equation (27) into equation (2) and following the same mathematical process described previously results in equation (28) for the line velocity (v):

$$v=GK(f-f_{up})+GQp+(S)(f+p) \tag{28}$$

Equation (29) shows that any change in load weight (ΔW) and any change in the force imposed by the operator on the end-effector (Δf) will result in a variation of the end-effector speed (Δv) such that:

$$(1+SE+GQE)\Delta v=(GK+S)\Delta f+(S+GQ)(\Delta W) \tag{29}$$

The load force feedback transfer function, (Q), effectively increases the system overall sensitivity to load from (S) to (S+GQ). If we define the apparent sensitivity to load, S', as:

$$S'=S+GQ \tag{30}$$

then equation (29) can be re-written as:

$$(1+SE+GQE)\Delta v=(GK+S)\Delta f+(S')\Delta W \tag{31}$$

Equation (31) is similar to equation (11), but the system sensitivity to load force is increased from (5) to (S'). Moreover all characteristics previously described in the three experiments are still valid. For example, the effect of this optional load feedback in Experiment 1. Equation (13), when the load feedback transfer function (Q) is used can be rewritten as equation (32):

$$\frac{GK+S}{S'}=-\frac{\Delta W}{\Delta f} \tag{32}$$

Comparing equations (13) and (32) demonstrates that, since (S') is larger than (S), if the operational speed is expected to remain unchanged, any increase in the load weight will lead to a greater increase in the required upward human force if the load force feedback (Q) is used. In other words, for a given increase in load weight, the operator feels more force when the load force feedback is used. The choice of load force feedback is optional. If (S) is sufficiently large to give a reasonable sensation for the variation of the load force to the operator, then one does not need to implement the load force feedback; if (S) is small, then implementation of load force feedback will improve system performance in a sense that the operator will have a more pronounced sensation of the variation of the load force.

Here I explain two simple variations of equation 27. Since operator force (f) is usually small in comparison with load force (p), then (p) in equation (27) can be replaced by ($f_R$):

$$e=K_M K(f-f_{up})+Qf_R \tag{33}$$

Also, rather than using load force as feedback, one can use $p_L$ (the force due to the weight and inertia of the load only) if ($p_L$) is readily available as shown in the example of FIG. 7B:

$$e=K_M K(f-f_{up})+Qp_L \tag{34}$$

Figure 18A:
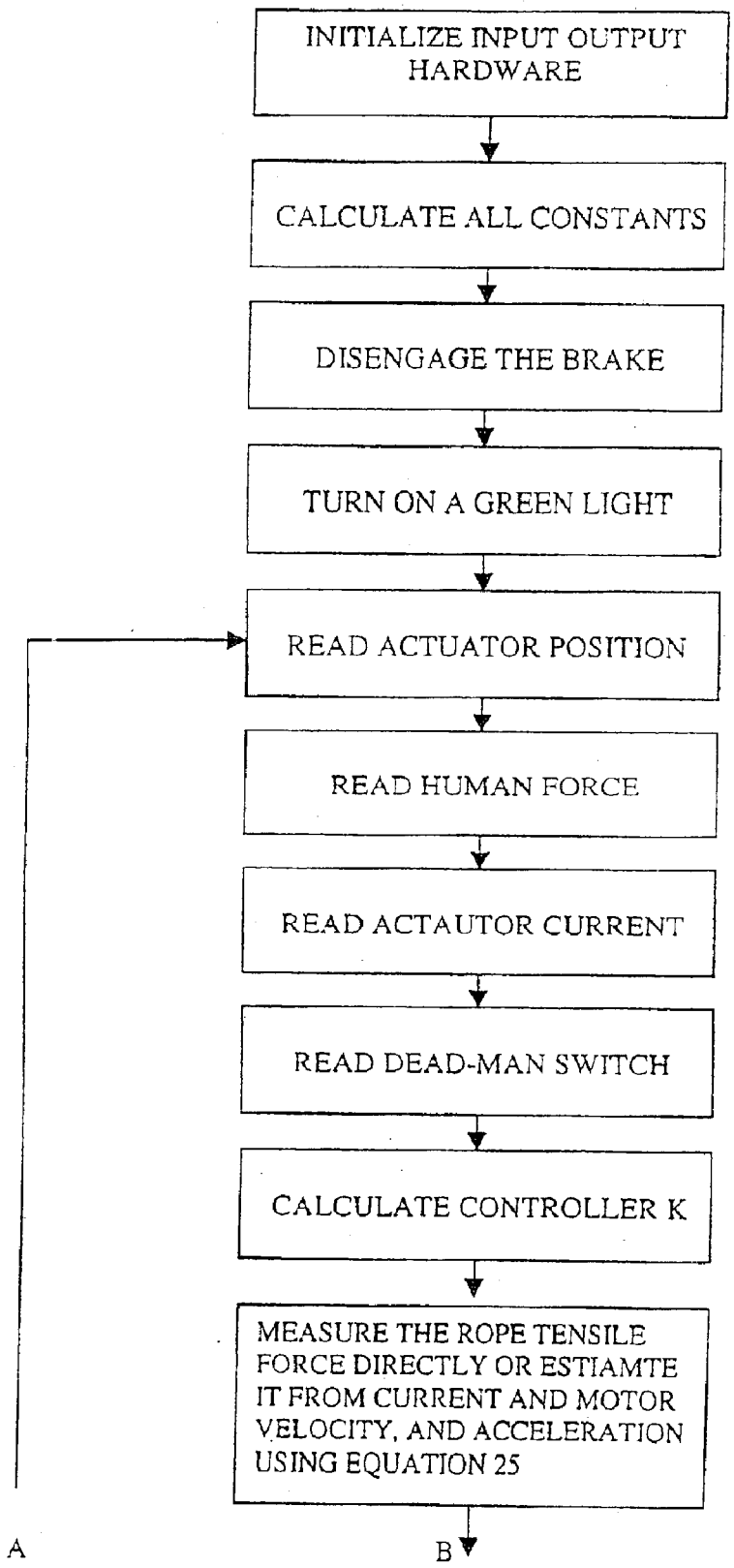
FIGS. 18A and 18B show flowcharts of software that can be used to drive a controller practicing the invention.
Figure 18B:
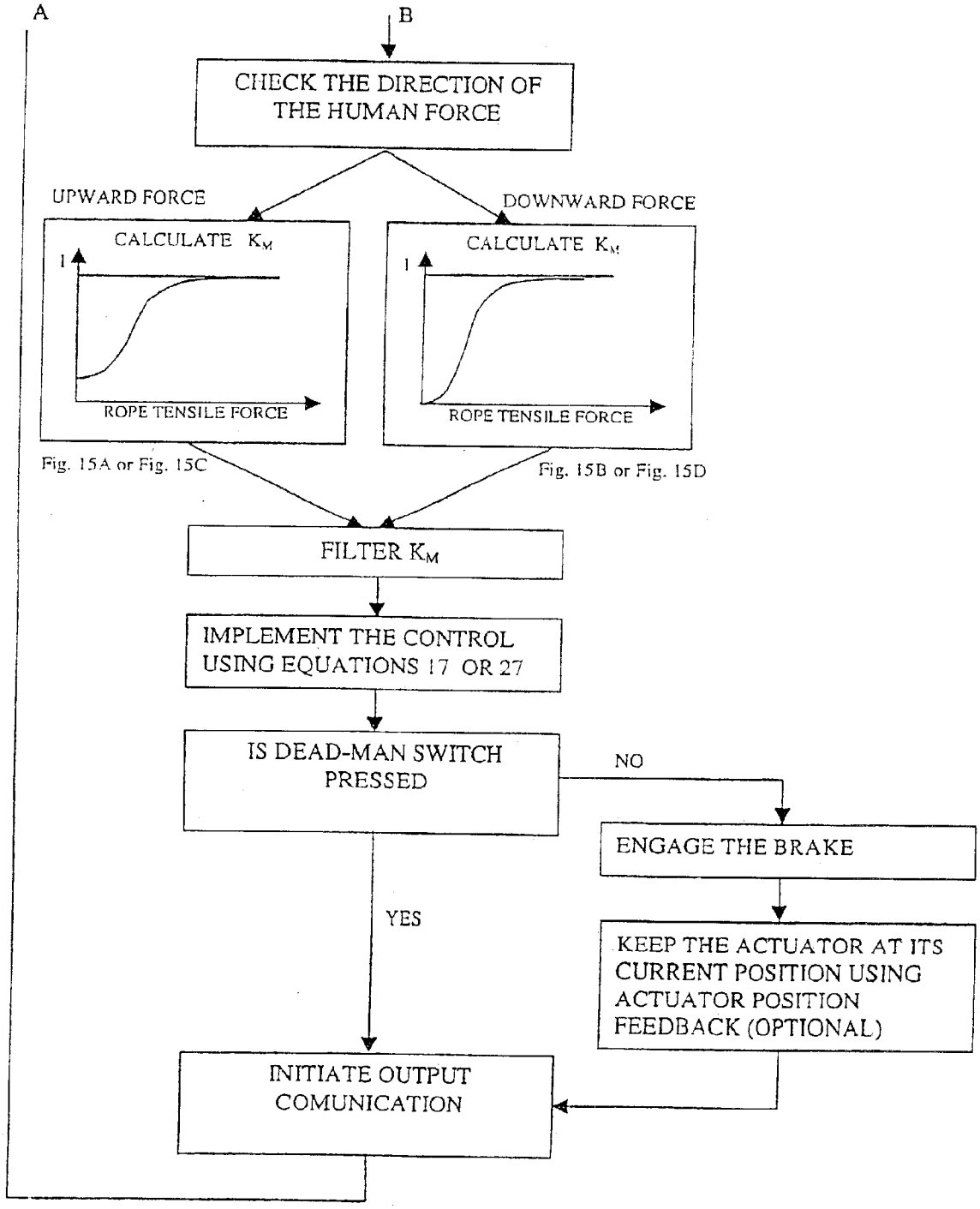

FIGS. 18A and 18B show a flowchart of a computer program that can be used in controller 20. The control program initializes all input and output hardware in the system first. This includes analog-to-digital, digital-to-analog and quadrature counters in addition to any other peripherals in the controller. After calculation of all constants needed in the controller, the controller disengages the frictional brake on the actuator and will energize a green light on the controller indicating that the system is ready to be operated. The controller then enters the main control loop; it reads the actuator position, human force, current in the actuator, and the dead-man switch. The software then implements the transfer function (K) on the signal representing the human force. The transfer function (K) should be chosen to guarantee the closed-loop system stability. Using the value of the actuator position, the controller will estimate the line tensile force using equation (17) above. Using the value of the human force, the software will determine if the human force is downward (+) or upward (−). Depending on the direction of the human force, the software calculates a value for $K_M$ using plots similar to FIGS. 15B and FIG. 15C. Since the value of $K_M$ is obtained from the plot of either FIG. 15B or FIG. 15C, there will be a discontinuity in calculation of magnitude of $K_M$. The jump among the various values of $K_M$ can be smoothed by using a digital filter. Therefore a digital filter is designed to filter high frequency components associated with $K_M$. In this embodiment, a digital low-pass filter was written in the software to smooth the value of $K_M$.

The software then checks to see if the dead-man switch is pressed or not. If the dead-man switch is pressed, then the software sends the modified value of (e) to the actuator. If the dead-man switch is not pressed the software keeps the actuator in its current position using a position controller and engages the friction brake. This friction brake engages and prevents the actuator from rotating when the dead-man switch is released. This friction brake adds more rigidity to the system when the operator is not attending the device. As an additional safety feature, I prefer to have the friction brake engage any time there is a power failure.

There are many hoists that use an intermediary device such as a valve, push-button, keyboard, switch, or teach pendent to adjust the lifting and lowering speed of the object being maneuvered. For example, in a valve-controlled hoist, the more the operator opens the valve, the greater the lifting speed of the object becomes. With an intermediary device, the operator does not have any sense of how much she/he is lifting because her/his hand is not in contact with the object but is busy operating a valve or a switch. However, it is possible for the operator to activate the intermediary device (e.g. DOWN push-button) to bring a load down while the load is constrained from moving downwardly. The method of preventing slack described above can be used with these hoists without lack of generality. In other words, the switches and sensors described here (e.g. FIGS. 9, 10A, 10B, 11A, 11B) can be used with these devices to send the controller information about the line tensile force (e.g. the magnitude of the line tensile force or lack of line tensile force). Moreover, if these devices are powered electrically, then the line tensile force can also be estimated from current measurement as described above.

Although particular embodiments of the invention are illustrated in the accompanying drawings and described in the foregoing detailed description, it is understood that the invention is not limited to the embodiments disclosed, but is intended to embrace any alternatives, equivalents, modifications and/or arrangements of elements falling within the scope of the invention as defined by the following claims. For example, while many of the embodiments described above use operator-applied force as the input to the system, the advantages that my system provides, particularly load weight sensitivity and slack prevention, can also benefit hoists that use valves or up-down switches to lift loads. Moreover, although specific equations have been set forth to describe system operation there are alternative ways to program the system to achieve specific performance objectives. The following claims are intended to cover all such modifications and alternatives.

I claim:

1. A hoist system improving responsiveness of a hoist that includes an end-effector held by an operator and connected to a load to be lifted, a sensor in the end-effector sensing operator-applied force during lifting and sending a signal representing operator-applied force to a controller, and a hoist actuator varying speed of movement of a line transmitting tensile force from the actuator to the end-effector to assist the operator in lifting the load, the hoist system comprising:

a. a load force estimator that sends a signal to the controller representing load force; and b. the controller controlling the actuator as a function of the estimated load force signal and the operator-applied force signal.

2. The hoist system of claim 1, wherein actuator speed is controlled as a function of the estimated load force signal and the operator-applied force signal according to the equation:

$$v=GK(f+f_{up})+GQp+S(f+p)$$

wherein v represents end-effector velocity, G represents an actuator transfer function, K represents a transfer function of the controller operating on f, f represents operator-applied force, $f_{up}$ is a constant, Q represents a controller transfer function operating on p, p represents estimated load force, and S represents actuator sensitivity transfer function.

3. The hoist system of claim 1, wherein the load force estimator is a force sensor.

4. The hoist system of claim 3, wherein the force sensor estimates load force as a function of tensile force on the line.

5. The hoist system of claim 3, wherein the force sensor estimates load force as a function of strain on the hoist.

6. The hoist system of claim 1, wherein the load force estimator uses current consumed by the actuator to estimate the load force.

7. The hoist system of claim 6, wherein the load force estimator includes a sensor that detects electric current flow to the actuator.

8. The hoist system of claim 1, wherein the controller is programmed so that during movement of the load the operator always bears some of the load force so that the operator feels the load during lifting movements.

9. The hoist system of claim 1, wherein the controller is programmed so that variations in lifting speed, operator-applied force and load force are functionally interrelated to require changes in lifting speed or operator-applied force in response to changing load force.

10. The hoist system of claim 1, wherein the controller responds to detection of lack of tensile force in the line by preventing unreeling of the line in response to a downward operator-applied force.

11. A method of improving the responsiveness of a hoist that includes an end-effector held by an operator and connected to a load to be lifted, a sensor in the end-effector that measures operator-applied force and sends a signal representing operator-applied force to a controller, and a hoist actuator varying speed of movement of a line transmitting tensile force from the actuator to the end-effector to assist the operator in lifting the load, the method comprising:

a. estimating load force with a load force estimator;

b. transmitting a load force signal from the load force estimator to the controller; and c. programming the controller to control actuator speed as a function of the load force signal and the operator-applied force signal.

12. The method of claim 11, including programming the controller to control actuator speed as a function of the load force signal and the operator-applied force signal according to the equation:

$$e=K(f-f_{up})+Qp$$

wherein e represents controller output, K represents a transfer function of the controller operating on f, f represents operator-applied force, $f_{up}$ represents a constant, Q represents a controller transfer function operating on p, and p represents estimated load force.

13. The method of claim 11, including estimating the load force using a force sensor.

14. The method of claim 13, including using a sensor that measures line tensile force to estimate load force.

15. The method of claim 13, including using a sensor that measures mechanical strain on the hoist to estimate load force.

16. The method of claim 11, including estimating the load force using a device that measures energy consumed by the actuator in lifting the load.

17. The method of claim 11, including programming the controller to make the actuator hold the load in a stationary position when a deadman switch on the end-effector is inactive.

18. A system for improving hoist responsiveness to operator input, wherein the hoist includes an end-effector held by an operator and connectable to a load to be lifted, a sensor in the end-effector detecting operator-imposed force during lifting and sending to a controller a signal representing operator-imposed force, a hoist actuator having an operating speed set by the controller, and a line transmitting tensile force between the actuator and the end-effector to assist the operator in lifting the load, the system comprising:

a. a load force estimator that determines a force on the line caused by a load being lifted;

b. the load force estimator sending a load force signal to the controller; and c. the controller varying lifting speed in response to the operator-imposed force as a function of the load force signal.

19. The system of claim 18, wherein the load force signal includes a force on the line caused by the end-effector.

20. The system of claim 18, wherein the load force estimator measures tensile force on the line.

21. The system of claim 18, wherein the load force estimator measures mechanical strain on the hoist.

22. The system of claim 18, wherein the load force estimator measures energy consumed by the actuator in supporting the load.

23. A hoist system giving an operator a realistic sense of a lifting task that the operator indicates by operator-applied force to an end-effector connected to a load and connected to a hoist by a line, a signal representing operator-applied force during the lifting task being implemented by a controller, operating an actuator connected to the end-effector by the line, the system comprising:

a. a load force measurer supplying a load force signal to the controller;

b. the controller operating the actuator to implement an operator-indicated lifting task variably in response to the load force signal and the operator-applied force signal; and c. the controller being programmed so that the operator must exert a greater operator-applied force for a heavier load than is required to raise a lighter load at the same speed.

24. The system of claim 23, wherein the load force estimator is a force sensor arranged to detect load force.

25. The system of claim 23, wherein the load force estimator derives the load force signal from current required by the actuator to support the end-effector and the load connected to it.

26. The system of claim 23, wherein for a given operator-applied downward force, an increase in load weight leads to an increased load lowering speed.

27. The system of claim 23, wherein a load weight increase without a change in load movement speed requires more operator-applied force for load raising and less operator-applied force for load lowering.

28. A method of controlling a hoist so that hand input by a hoist operator and signaling a lifting task is implemented by the hoist to give the operator a realistic sense of a mass of a load being lifted, the method comprising:

a. producing a load force signal representing force caused by being lifted; and b. using the load force signal to drive the hoist so that the operator must increase operator-applied force to raise a heavier load at the same speed as a lighter load.

29. The method of claim 28, including deriving the load force signal from current required for the hoist to support the load.

30. The method of claim 28, including deriving the load force signal from a force sensor.

31. The method of claim 28, including reducing the operator-applied force required to lower a heavier load at the same speed as a lighter load.

32. The method of claim 28, wherein a load weight increase without a change in operator-applied force causes reduced load raising speed and increased load lowering speed.

33. The method of claim 28, wherein a load weight increase without a change in load movement speed requires more operator-applied force for load raising and less operator-applied force for load lowering.

34. An improved hoist control comprising:

a. load force estimator producing a signal as a function of the force of a load supported by the hoist; and b. a controller driving an actuator of the hoist to vary hoist assist to the operator so that as load force increases, a given operator-applied force causes reduced load raising speed and increased load lowering speed.

35. The improvement of claim 34, wherein the load force signal is derived from current required for the actuator to support the load.

36. The improvement of claim 34, wherein the load force signal is derived from energy consumed by the actuator to support the load.

37. The improvement of claim 34, wherein the load force signal is derived from a force sensor.

38. A hoist system controlling load lifting speed responsively to operator input, the hoist system comprising:

a. a controller receiving signals representing load force and operator-applied force;

b. the controller being programmed to control lifting speed as a function of both signals; and c. the controller being further programmed so that a change in load weight increases and a change in operator-applied force cause a change in load speed according to the equation:

$$(1+SE+GQE)\Delta v=(GK+S)\Delta f+(S+GQ)(\Delta W)$$

where S represents an actuator sensitivity transfer function, E represents load dynamics, G represents an actuator transfer function, Q represents a controller transfer function operating on p, Δv represents change in end-effector velocity, Δf represents change in operator-applied force, K represents a transfer function of the controller operating on f and ΔW represents change in load weight.

39. The system of claim 38, wherein the controller is programmed so that an operator must apply a greater upward and a smaller downward force for a heavier load than is needed to move a lighter load at the same speed as demonstrated by the equation:

$$0=(GK+S)\Delta f+(S+GQ)(\Delta W)$$

where G represents an actuator transfer function, K represents a transfer function of the controller operating on f, S represents an actuator sensitivity transfer function, Δf represents change in the force imposed by the operator, Q represents a controller transfer function operating on p, and ΔW represents change in load weight.

40. The system of claim 38, wherein the controller is programmed so that for a given weight any increase in speed of movement of the load will require additional operator-applied force according to the equation:

$$(1+SE+GQE)\Delta v=(GK+S)\Delta f$$

where S represents an actuator sensitivity transfer function, E represents load dynamics, G represents an actuator transfer function, Q represents a controller transfer function operating on p, Δv represents change in end-effector velocity, K represents a transfer function of the controller operating on f, and Δf represents change in force imposed by the operator.

41. The system of claim 38, wherein for a given operator-applied force a change in load weight will cause a corresponding change in end-effector speed according to the equation:

$$(1+SE+GQE)\Delta v=(S+GQ)(\Delta W)$$

where S represents an actuator sensitivity transfer function, E represents load dynamics, G represents an actuator transfer function, Q represents a controller transfer function operating on p, $\Delta v$ represents change in end-effector velocity, and $\Delta W$ represents change in load weight.

42. The system of claim 38, including a load force estimator formed as a force sensor.

43. The system of claim 38, including a load force estimator using current consumed by an actuator to estimate load force.

44. A control system for a hoist having a controller of an actuator and a hoist line extending from the actuator to an end-effector connectable to a load, the control system comprising:

a. a detector signaling the controller whenever absence of tensile force in the line occurs; and b. the controller preventing the actuator from unreeling line in response to an operator input of downward movement whenever the signal representing absence of tensile force in the line occurs.

45. The control system of claim 44, wherein the detector is a switch in communication with the line.

46. The control system of claim 44, wherein the detector determines absence of line tensile force from detection of load force and operator input.

47. The control system of claim 44, wherein the detector determines absence of line tensile force from current required by the actuator in supporting the line.

48. The control system of claim 44, wherein the detector is capable of generating a binary signal having one state when line tensile force is zero and a second state when line tensile force is not zero.

49. The control system of claim 44, wherein the detector is capable of generating a binary signal having one state when the end-effector is constrained from moving downwardly and a second state when the end-effector is not constrained from moving downwardly.

50. The control system of claim 44, wherein the detector includes a switch that can move to one position when the line is slack and can move to another position when the line is not slack.

51. The control system of claim 44, wherein the controller issues an upward velocity command signal to generate a non-zero tensile force on the line in response to an operator input of upward movement whenever the signal from the detector represents absence of tensile force on the line.

52. A method of preventing a hoist line from becoming slack, the method comprising:

a. detecting absence of tensile force in the line;

b. signaling a controller of an actuator of the hoist whenever the line tensile force is absent; and c. programming the controller to prevent the actuator from unreeling line in response to operator input of downward movement whenever line tensile force is absent.

53. The method of claim 52 including detecting line tensile force with a switch communicating with the line.

54. The method of claim 52 including detecting a line tensile force from load force and operator input.

55. The method of claim 52 including detecting line tensile force from energy consumed by the actuator in supporting the line.

* * * * *